US006847019B2

(12) United States Patent
Yokozeki et al.

(10) Patent No.: US 6,847,019 B2
(45) Date of Patent: Jan. 25, 2005

(54) INDUCTION HEATING ROLLER DEVICE, HEATING ROLLER FOR INDUCTION HEATING ROLLER DEVICE, FIXING APPARATUS AND IMAGE FORMING APPARATUS

(75) Inventors: Ichiro Yokozeki, Kanagawa-ken (JP); Teiji Shimokawa, Kanagawa-ken (JP); Masaaki Kawamura, Kanagawa-ken (JP)

(73) Assignee: Harison Toshiba Lighting Corporation, Imabari (JP)

( * ) Notice: Subject to any disclaimer, the term of this patent is extended or adjusted under 35 U.S.C. 154(b) by 45 days.

(21) Appl. No.: 10/052,260

(22) Filed: Jan. 23, 2002

(65) Prior Publication Data

US 2002/0125244 A1 Sep. 12, 2002

(30) Foreign Application Priority Data

Jan. 24, 2001 (JP) ..... 2001-016335

(51) Int. Cl.[7] ..... H05B 6/14; G03G 15/20

(52) U.S. Cl. ..... 219/619; 219/660; 219/670; 399/330; 399/335

(58) Field of Search ..... 219/619, 660, 219/661, 662, 663, 665, 668, 670, 671, 655, 656; 399/328, 330, 331, 335, 336, 329

(56) References Cited

U.S. PATENT DOCUMENTS 2,181,274 A * 11/1939 Jackson et al. ..... 219/670
4,908,489 A * 3/1990 Panecki et al. ..... 219/625
6,255,632 B1 * 7/2001 Yokoyama et al. ..... 219/619
6,292,647 B1 * 9/2001 Ishida ..... 399/330

FOREIGN PATENT DOCUMENTS

| | | | |
|---|---|---|---|
| JP | 54-140241 | * 10/1979 | ..... 219/667 |
| JP | 59-33787 | 2/1984 | |
| JP | 2000-215971 | 8/2000 | |
| JP | 2000-215974 | 8/2000 | |

* cited by examiner

*Primary Examiner*—Philip H. Leung
(74) *Attorney, Agent, or Firm*—Oblon, Spivak, McClelland, Maier & Neustadt, P.C.

(57) ABSTRACT

An induction heating roller, a fixing apparatus and an image forming apparatus are disclosed as including a heating roller (TR) comprised of a hollow roller base body (BB), composed of electrically insulating material, and a plurality of secondary coil components (ws), composed of closed circuits, respectively, which are formed over the roller base body. The heating roller (TR) internally receives an induction coil unit (IC) including a primary coil (wp) which is coupled with the secondary coils in a core-less transformer coupling relationship. The secondary coil components (ws) of the heating roller (TR) have a secondary resistance value ($R_a$) which is nearly equal to a secondary reactance ($X_a$), i.e. in case of $R_a/X_a=\alpha$, a formula is expressed as $0.1<\alpha<10$. Further, the primary coil (wp) of the induction coil unit (IC) is comprised of a plurality of coil components which are connected between a wire pair (WP) in parallel to one another.

14 Claims, 14 Drawing Sheets

INDUCTION HEATING ROLLER DEVICE, HEATING ROLLER FOR INDUCTION HEATING ROLLER DEVICE, FIXING APPARATUS AND IMAGE FORMING APPARATUS

BACKGROUND OF THE INVENTION

The present invention relates to an induction heating roller device, a heating roller for the induction heating roller, a fixing apparatus and an image forming apparatus.

A heating roller, which includes a thermal source composed of a halogen lamp, has heretofore been employed to thermally fix toner image onto record medium. Such a technology encounters an issue such as a prolonged warm-up time or an insufficient thermal capacity. To address this issue, considerable research and development work has been undertaken in the past to commercially apply an induction heating technology.

Japanese Patent Publication NO. 2000-215974 discloses an excitation coil located in close proximity to an object body to be heated for causing induction current to flow through the object body, with the excitation coil including a coil wire material wound in a plane and deformed in a shape to cope with a curved wall of the object body while a magnetic core is located in a position opposed to the object body with respect to both ends of the excitation coil in a longitudinal direction thereof such that the magnetic core cope with a curved surface of the excitation coil. (Related Art 1) Japanese Patent Publication NO. 2000-215971 discloses an induction heating device which includes a heating rotor body having an electromagnetic induction heating property, and a magnetic flux generating unit located inside the heating rotor body for generating magnetic flux of a high frequency to cause the heating rotor body to be heated up due to an electromagnetic induction heating for thereby heating the object body, with the magnetic flux generating unit including a core, made of magnetic material, and an electromagnetic transducer coil wound around the magnetic core, which is comprised of a core portion around which the electromagnetic transducer coil is wound, and a magnetic flux induction core portion opposed between distal ends portions in a magnetic flux gap for concentrating a magnetic flux at a portion of the heating rotor body more intensively than that concentrated at the core portion. (Related Art 2)

Any one of the Related Arts 1 and 2 employs a heating technology that uses an eddy-current loss which provides the same effect commercially realized in an IH cooker. A high frequency electric current to be utilized in such a heating technology is selected to have a frequency ranging from 20 to 100 kHz.

On the contrary, Japanese Patent Publication NO. 59-33787 discloses a high frequency induction heating roller which is comprised of a cylindrical roller body composed of electrically conductive material, a cylindrical bobbin located inside the cylindrical roller body in a concentric relationship, and an induction coil wound around an outer circumferential periphery of the bobbin in a spiral relationship to induce induction current in the roller body to compel it to be heated up. (Related Art 3)

With such a structure of the Related Art 3, the cylindrical roller body serves as a secondary coil of a closed circuit and the induction coil serves as a primary coil, with the primary and secondary coils being coupled in a transformer relationship to cause secondary voltage to be induced in the secondary coil of the cylindrical roller body. The presence of flow of secondary electric current through the closed circuit of the secondary coil responsive to the secondary voltage compels the cylindrical roller body to be heated up, i.e. in a so-called secondary side resistance heating technology. With this technology, the presence of stronger magnetic coupling than that achieved in the heating technology using the eddy-current loss increases a stationary efficiency while enabling the whole of the heating roller to be heated up, resulting in an advantage wherein a fixing device becomes more simple in structure than those of the Related Arts 1 and 2.

However, the Related Art 3 encounters an issue wherein a warm-up time can not be so shortened as expected. Upon considerable research and study conducted by the inventor, such an issue is deemed to originate from the resistance value of the secondary coil formed in the heating roller, which is not supervised.

In the Related Art 3, further, with the use of such a low frequency ranging from 20 to 100 kHz that is obtained in an IGBT inverter that is used in cooking equipments such as an induction heating type cooker or range, it is difficult for a high electric power transmitting efficiency to be obtained.

SUMMARY OF THE INVENTION

It is therefore an object of the present invention to provide an induction heating roller device and a heating roller for the induction heating roller device, and a fixing apparatus and an image forming apparatus, using such component parts, which are able to obtain a high electric power transmitting efficiency.

It is another object of the present invention to provide an induction heating roller device and a heating roller for the induction heating roller device wherein the heating roller has a temperature distribution as uniform as possible, a fixing apparatus and an image forming apparatus using such component parts.

According to a first aspect of the present invention, there is provided an induction heating roller device which comprises an induction coil unit having a primary coil, and a hollow heating roller having a secondary coil coupled to the primary coil of said induction coil unit through a coreless transformer coupling and having a secondary resistance value substantially equal to a secondary reactance, said heating roller being rotatably supported. Further, the secondary coil may be formed of a closed circuit.

The present invention will be described hereinafter in conjunction with terminologies based on the following definitions and technical meanings.

Induction Coil Device

The induction coil device is energized, i.e. excited with an alternating electric power supply and, more preferably, with a high frequency output of a high frequency electric power supply. Alternatively, the induction coil unit is comprised of the primary coil which is coupled with the secondary coil of the heating roller through a core-less transformer coupling. The primary coil may be held stationary with respect to the rotating heating roller or may be rotated either together with the heating roller or separately from the same. Also, when it is desired to rotate the primary coil, a rotational current collecting mechanism may be located between the alternating current power supply and the induction coil unit. The "core-less transformer coupling" means not only a complete core-less transformer coupling but also a transformer coupling which seems to remain in a substantially core-less relationship.

Further, the induction coil unit may be comprised of a coil bobbin for supporting the primary coil. The coil bobbin may be formed a winding recess for achieving well-ordered winding of the coil.

Furthermore, the induction coil unit allows the primary coil to be formed in a single coil component or in a plurality of coil components. In case of the primary coil composed of the single coil component, the primary coil may be located at a substantially central area of the heating roller. In case of the primary coil composed of the plurality of coil components, the plural coil components may be equidistantly distributed over the surface of the heating coil along an axis thereof. And, respective primary coil components may be connected to the alternating current electric power supply in parallel to one another.

Heating Roller

The heating roller includes the secondary coil which is coupled with the primary coil through the core-less transformer coupling. And, the closed circuit has the secondary resistance value which is substantially equal to the secondary reactance of the secondary coil. Further, the secondary coil may be formed in a closed circuit. In this connection, an expression that the secondary resistance value and the secondary reactance are "substantially equal" to one another is meant by the fact that, when the secondary resistance value is expressed as $R_a$ and the secondary reactance is expressed as $X_a$ and when $\alpha=R_a/X_a$, a formula 1 is satisfied. The reason why such a formula is defined will be described below in detail. Further, the secondary resistance value can be obtained by measurement. The secondary reactance can be obtained by calculation of the formula 1.

$$0.1<\alpha<10 \quad \text{[Formula 1]}$$

Further, the heating roller includes the secondary coil which may be formed in a single coil component or in a plurality of coil components. When forming the plurality of coil components as the secondary coil, it is preferable for the plurality of coil components to be dispersedly located on the heating roller along its axial length. In order to support the secondary coil, it may be possible to employ the roller base body made of electrically insulating material. And, the secondary coil may be located on the inner or outer circumferential peripheries of the roller base body or may be internally located in the roller base body.

Furthermore, the heating roller may be rotated with a mechanism composed of suitably selected one of various related art structures. Also, when thermally fixing toner image onto record medium, the pressure roller is located in direct opposition to the heating roller, with record medium, which is formed with toner image, being transferred through between the two rollers such that the toner image is heated and melted to the record medium.

OPERATION OF THE PRESENT INVENTION

With the structure of the present invention discussed above, a highly improved electric power transmission efficiency is obtained between the induction coil unit and the heating roller. Such a reason is described below in detail.

First, an equivalent circuit of the induction heating roller device is considered in conjunction with FIG. 1.

FIG. 1 shows a circuit diagram illustrating an equivalent circuit of the induction heating roller device according to the present invention.

In FIG. 1, a reference symbol $Z_{ca}$ designates an input impedance as viewed from the primary coil wp, a reference symbol $X_a$ designates reactance of the secondary coil ws, a reference symbol Ra designates a secondary resistance value and a reference symbol k designates a coupling coefficient of the primary coil wp and the secondary coil ws The input impedance $Z_{ca}$ as viewed from the primary coil wp is expressed by the following formula 2:

$$Zca = k^2 \cdot Xc \cdot \frac{Ra \cdot Xa}{Ra^2 + Xa^2} + j \cdot Xc \cdot \left(1 - k^2 \cdot \frac{Xa^2}{Ra^2 + Xa^2}\right) \quad \text{[Formula 2]}$$

The ratio between the real part and the imaginary part of the formula 2, i.e. $Q_{ca}=\mathrm{Im}Z_{ca}/\mathrm{Re}Zc_a$ is expressed by a formula 3.

$$Qca = \frac{\left(\frac{Ra}{Xa}\right)^2 + 1 - k^2}{\left(\frac{Ra}{Xa}\right) \cdot k^2} \quad \text{[Formula 3]}$$

Here, to execute variable arrangement, when substituting $R_a/X_a=\alpha$ for the formula 3, a formula 4 is obtained as:

$$Qca = \frac{\alpha^2 + 1 - k^2}{\alpha \cdot k^2} \quad \text{[Formula 4]}$$

When conducting a search for variation in $Q_{ca}$ based on the primary coil while varying $\alpha$ for each coupling coefficient using the formula 4, $Q_{ca}$ varies as shown in FIG. 2.

FIG. 2 shows a graph illustrating the relationship between $\alpha$ and $Q_{ca}$ for each coupling coefficient for illustrating the operating principle of the induction heating roller according to the present invention.

In FIG. 2, the abscissa axis designates $\alpha$ and the axis of ordinates designates $Q_{ca}$.

As shown in FIG. 2, the larger the coupling coefficient k, the smaller will be the value of $Q_{ca}$ based on the primary coil. Further, there exists one a which makes $Q_{ca}$, based on the primary coil, to have the minimum value for each coupling coefficient. As a consequence, when the inductance remains in a fixed value due to the heating roller with a structure which is determined, it is understood that optimization of $\alpha$ is synonymous with optimization of the secondary resistance value.

Now, the electric power transmission efficiency is calculated using $Q_{ca}$ based on the primary coil. Also, in order to simplify calculation and to make only the electric power transmission efficiency to be at stake, the amount of heat transfer due to radiation and convection is omitted and it is assumed that energy, which can not be directly transferred to the secondary coil of the heating roller through the magnetic coupling, disappears completely.

Let consider about $Q_{ca}$ based on the primary coil separately for a first case when the heating roller is located at the secondary side, i.e. $Q_L$ during a loading state and for a second case when measurement is enabled for the independent primary coil, i.e. $Q_U$ during an unloading state. The primary coil has power factors determined before and after the induction coil unit is inserted through the heating roller, i.e. power factors determined before and after the loading and unloading states, with the power factors varying responsive to the load as expressed by formulae 5 and 6.

$$\cos\{\tan^{-1}(Q_U)\} \quad \text{[Formula 5]}$$

$$\cos\{\tan^{-1}(Q_L)\} \quad \text{[Formula 6]}$$

When supplying electric power $P_c$ to the primary coil, apparent power $P_r$ of the primary coil is expressed as follows.

$$P_r = P_c \cos\{\tan^{-1}(Q_L)\} \quad \text{[Formula 7]}$$

Here, as the coupling coefficient k is small, the power factor vary in a small range before and after the loading state such that the loss $P_{loss}$ caused by the apparent power $P_r$ of the primary coil is expressed by approximation determined by the following formula.

$$P_{loss} \approx P_r \cdot \cos\{\tan^{-1}(Q_U)\} = P_c \cdot \cos\{\tan^{-1}(Q_U)\}/\cos\{\tan^{-1}(Q_L)\} \quad \text{[Formula 8]}$$

Calculating the power transmission efficiency $\eta_c$ using the formula 8 compels it to be expressed by formula 9.

$$\eta_c \approx 1 - P_{loss}/P_c = 1 - \cos\{\tan^{-1}(Q_U)\}/\cos\{\tan^{-1}(Q_L)\} \quad \text{[Formula 9]}$$

The formula 9 represents that when the power factor cos $\{\tan^{-1}(Q_L)\}$ of the primary coil during the unloading state or when the load is not connected to the primary coil remains at a fixed level, as the power factor cos $\{\tan^{-1}(Q_L)\}$ of the primary coil during the loading state or when the load is connected to the primary coil decreases, the electric power transmission efficiency $\eta_c$ of the primary coil decreases. The presence of the power factor remaining at a low level during mounting of the load means that $Q_L$ is large.

Now, the range of magnitude $Q_L$ during mounting of the load is described below in detail with reference to FIG. 3.

In FIG. 3, a reference symbol IC designates an induction coil unit, a reference symbol TL designates a transformer coupling type load and a reference symbol EL designates an eddy-current loss type load.

The induction coil unit IC is comprised of a bobbin CB and the primary coil wp. The bobbin CB is composed of a cylindrical member having an outer diameter of 17.7 mm and a length of 120 mm. The primary coil wp is composed of an electrically insulated soft copper wire, having a diameter of 1.5 mm, tightly wound on the bobbin CB in twenty turns and has a coil diameter of 20.7 mm, a coil length of 30 mm and a wire length of 140 mm. Further, distal ends of the primary coil wp extend rearward from a distal end of the bobbin CB by a distance of 3 mm. Also, "the wire length" refers to a distance between a distal end of a wire pair WP and the distal end of the bobbin CB.

The transformer coupling type load TL forms a heating roller which has been employed in practical use for a halogen lamp type heater and includes a cylindrical body, made of iron, which has an outer diameter of 30 mm and an inner diameter of 25 mm, with an outer circumferential periphery of the cylindrical body being covered with a plastic resin layer of a thickness of 4 mm. Thus, the iron cylindrical body forms the secondary coil.

The eddy-current loss type load EL is prepared as a comparison example and is composed of stainless steel plate having a length of 300 mm, a width of 400 mm and a thickness of 2 mm.

With the conditions given above, the inductance of the primary coil wp of the induction coil unit IC during the non-mounting state of the load is measured, with a measured result being plotted in FIG. 4.

FIG. 4 is a graph illustrating the variations in the inductance and the coupling coefficient of the primary coil, during the non-mounting state of the load in a preliminary test conducted for confirming the operating principal of the induction heating roller unit, plotted in terms of a measured frequency.

In FIG. 4, the axis of abscissa designates the measured frequency (MHz), and the left and right of the axis of ordinates designates the inductance ($\mu$H) and the coupling coefficient, respectively. A curve A indicates the inductance, and a curve B indicates the coupling coefficient.

As is apparent from FIG. 4, the inductance remains at a substantially fixed level of about 4.3 $\mu$H in the measured frequency range. Accordingly, it appears that such a primary coil is less affected with a distribution capacity to be suitably employed for the induction coupling. Further, when obtaining the coupling coefficient from the inductance before and after the mounting of the primary coil wp with respect to the transformer type load TL by calculation, it is confirmed as shown in the graph that the coupling coefficient remains at a substantially fixed level of about 0.5 in the measured frequency range. Accordingly, under a condition where the secondary impedance is fixed, it appears that a terminal impedance based on a primary conversion can be designed to be substantially dependent on the operating frequency. In addition, when obtaining Q during the non-mounting state of the load, it varies as shown in FIG. 5.

FIG. 5 is a graph illustrating the variation of $Q_U$ in terms of the measured frequency of the primary coil during the non-mounting state of the load in the preliminary test conducted for confirming the operating principal of the induction heating roller unit, plotted in terms of a measured frequency.

In FIG. 5, the axis of abscissa indicates the measured frequency (MHz), and the axis of ordinates indicates $Q_U$.

As will be appreciated from the graph in FIG. 5, $Q_U$ of the primary coil wp has a maximum level at the frequency of about 3 MHz. Accordingly, the primary coil wp has the minimum loss at the frequency of 3 MHz.

By the way, $Q_U$ of the primary coil has a value of 62 at the frequency of 3 MHz as seen from the graph. On the other hand, in FIG. 2, when the coupling coefficient is 0.5, the minimum $Q_{ca}$, i.e. $Q_L$ is 7 with $\alpha \approx 1$. As a consequence, calculating the electric power transmission efficiency $\eta_c$ with the minimum $Q_L$ of the primary coil employed in the presently conducted test using the formula 9 results in a value of 88.6%. On the contrary, since the maximum $Q_L$ with the coupling coefficient of 0.5 has a value of about 53, calculating the electric power transmission efficiency $\eta_c$ with the condition given above in a similar manner results in a value of 14.7%.

From the foregoing results, it appears that optimization of the secondary resistance value enables the electric power transmission efficiency to be increased. In this connection, the optimization is meant that $R_a$ is nearly equal to $X_a$. And, although a phrase in that "$R_a$ is nearly equal to $X_a$" is meant that $R_a$ remains in a range of 0.1 to 10 times $X_a$ as will be understood from the formula 1 discussed above, such an allowable range refers to a range which enables a high level of the electric power transmission efficiency to be obtained when taking the resistance temperature coefficient of the secondary coil and the product variations thereof as well as the temperature rise of the heating roller into consideration. More preferably, the number of times is in a range between 0.25 and 4. Even further preferably, the number of times is in a range between 0.5 and 2.

Next, a description will be given to the eddy-current loss type load EL which serves as the comparison. $Q_U$ and $Q_L$ of the primary coil wp have been measured by separating the primary coil wp of the induction coil unit IC apart from the eddy-current loss type load EL or compelling the primary coil to approach an area spaced by a distance of 3 mm from the load EL. As a result, the coupling coefficient was 0.303 and was clearly less than that of the transformer type load. Also, $Q_U$ and $Q_L$ of the primary coil had the relations $Q_U$=7.4 and $Q_L$=5.4. Then, calculating the electric power transmission efficiency using the formula 9 has resulted in a value of 26.0%. Also, the measurement has been conducted with the frequency of approximately 40 kHz in practical use. Since the actual load is the heating roller and no large variation exists in the inductance of the magnetic flux path, there is no big difference in the inductance between the loads formed either in a flat shape or in a roller shape. Also, when measuring the electric power transmission efficiency even with the measured frequency of 1 MHz, the electric power transmission efficiency was no more than 55%.

Further, the temperature rise time of the secondary coil in a core-less transformer coupling has been measured by an experimental test shown in FIG. 6.

FIG. 6 is a schematic view illustrating a measuring system for the temperature rise of the secondary coil in the induction heating unit according to the present invention.

In FIG. 6, a reference symbol HFG designates a high frequency electric power supply, a reference symbol MC designates a matching circuit, a reference symbol wp designates a primary coil and a reference symbol ws designates a secondary coil.

The high frequency electric power supply HFG produces a high frequency of 13.56 MHz.

The primary coil wp is composed of an aluminum wire in two turns and has a primary inductance of 170 nH.

The secondary coil ws is composed of a coil in one turn formed in a ring shape with a width of 10 mm, a thickness of 0.3 mm and a diameter of 20 mm. In this connection, the secondary resistance value is not optimized.

With the condition given above, the time interval wherein the surface temperature of the secondary coil ws reaches 150° C. was measured with the measured result being plotted in FIG. 7.

FIG. 7 is a graph illustrating the measured result of the temperature rise of the secondary coil of the induction coil unit according to the present invention.

In FIG. 7, the axis of abscissa designates input electric power (W) and the axis of ordinates indicates a required time interval (second) for heating.

As now apparent from the graph of FIG. 7, the heating time is shortened in substantially proportion to the input electric power and the temperature of the secondary coil is raised in a fairly short time period. As previously noted above, the optimization of the secondary resistance value improves the electric power transmission efficiency, with a resultant further decrease in the time period required for heating.

In summary, according to the present invention, the presence of the secondary coil, of the heating roller, which is coupled with the primary coil of the induction coil unit through the core-less transformer coupling with the secondary coil of the heating roller having the secondary resistance value that is nearly equal to the secondary reactance allows the electric power transmission efficiency from the induction coil unit to the heating roller to be highly improved, thereby enabling the heating roller to be effectively heated up in a shortened time period.

According to a second aspect of the present invention, in addition to the feature of the induction heating roller device of the first aspect of the present invention, the induction heating roller device further features the provision of a wire pair extending from the primary coil, and a capacitor connected to the wire pair in close proximity to the primary coil An electric circuit having a load composed of the induction coil has a low power factor. Further, the electric power supply is required to have an increased capacity with an increase in the electric power to be supplied. With the electric power supply having a low capacity, although the electric power supply can be received in an internal space of the heating roller, it is a general practice for the electric power supply to be located outside the heating roller due to a specific relationship between the electric power to be supplied and the heating roller with its suitable axial length and its inner diameter designed in a practical use. Thus, it is required for the wire pair to be prepared for providing electrical connection between the induction coil unit and the electric power supply. And, due to a lowered power factor, electric current flowing through the wire pair relatively increases, causing heat to be generated in the wire pair and an electric power transmission efficiency o be lowered with a subsequent insulating deterioration. Further, the larger the electric current flowing through the wire pair, the larger will be noise radiating from the wire pair, with a resultant issue such as an increase in danger of adversely affecting peripheral units.

According to the present invention, the presence of the capacitor connected to the wire pair in close proximity to the primary coil as discussed above allows the power factor of the electric current flowing through the wire pair to be improved, thereby decreasing the amount of electric current flowing through the wire pair. Thus, the above issue is effectively addressed.

In case of the primary coil composed of the plurality of coil components separately connected to the wire pair in parallel to one another, a plurality of capacitors may be connected to the wire pair in parallel to the primary coil components, respectively, or a single piece of capacitor may be connected to the wire pair at a position of the electric power supply of the primary coil in the most proximity thereto, i.e. in the vicinity of the end of the heating roller. With such an arrangement, the capacitors are located in a relatively low temperature environment.

According to a third aspect of the present invention, in addition to the feature of the induction heating roller device of the second aspect of the present invention, the induction heating roller device further features that the primary coil includes a plurality of primary coil components separately distributed along the axis of the heating roller and connected between a pair of wires and that a plurality of capacitors are connected between the pair of wires in close proximity to the plurality of primary coil components in parallel to one another.

According to the present invention, in case of the induction coil unit composed of the plurality of primary components, since the plurality of capacitors are connected to the pair of wires in close proximity to the primary coil components, respectively, it is possible for the power factor of electric current flowing through the wire pair in close proximity to the primary coil components to be improved for thereby decreasing the amount of electric current.

According to an fourth aspect of the present invention, in addition to the feature of the induction heating roller device of the first aspect of the present invention, the induction heating roller device features the provision of a plastic resin layer covered over the outermost circumferential periphery of the heating roller.

The plastic resin layer serves to allow the surface temperature of the heating roller to be distributed to a level as uniform as possible. Further, the plastic resin layer serves to smooth the surface of the heating roller. As a consequence, the plastic resin layer is designed to have a thickness to achieve the functions previously discussed above. In this respect, if the plastic resin layer has an excessive thickness, the temperature rise in the surface of the layer of the heating roller is delayed, resulting in crack due to a difference in a thermal expansion coefficient. To address such an issue, the plastic resin layer must be selected to have a suitable value, preferably within a range between 0.5 to 5 mm.

Furthermore, the plastic resin layer may comprise a multi-layered structure. For example, the multi-layered structure may be comprised of the plural laminated layers of different plastic resins.

Moreover, the plastic resin layer may be comprised of heat resistance material that resists the temperature rise of the heating roller, such as fluorocarbon polymers, silicone resin or epoxy resin.

With such a structure of the present invention described above, the surface temperature of the heating roller is maintained at a level as uniform as possible, providing an ease of uniformly heating an object body to be heated. Furthermore, since the surface of the heating roller is smoothed, the heating roller is brought into contact with the object body in a uniform manner, rendering it easy to uniformly heat the object body.

According to a fifth aspect of the present invention, there is provide an induction heating roller device which comprises an induction coil unit having a primary coil, a hollow heating roller having a secondary coil coupled to the primary coil of said induction coil unit through a coreless transformer coupling and having a secondary resistance value substantially equal to a secondary reactance, said heating roller being rotatably supported, and a power supply including a high frequency inverter composed of switching elements including unipole elements for producing a high frequency output of a frequency of more than 1.1 MHz to energize the primary coil of said induction coil unit. The unipole elements include MOSFETs, respectively.

The electric power supply produces the output of high frequency of more than 1 MHz by which the primary coil of the induction coil unit is energized. The high frequency is generated with the high frequency inverter. The high frequency inverter has a circuit configuration which is not limited and may comprise a half-bridge type inverter and, more preferably, a series-resonance type inverter.

In summary, further, the electric power supply may have the high frequency inverter and, in addition thereto, an active filter such as a switching regulator connected to a direct current input of the high frequency inverter. In this case, a PWM control is performed in a switching regulator to control the input voltage of the high frequency direct current inverter for thereby controlling the output voltage of the high frequency. This results in an ease of variable temperature control of the heating roller or of maintaining the same at a fixed value. In order to fixedly maintain the temperature of the heating roller, further, it is arranged such that a temperature sensor may be incorporated in the heating roller or the induction coil unit for monitoring the temperature of the heating roller with a view to controlling the switching regulator or the high frequency inverter in a feedback loop. However, the direct current input of the high frequency inverter may be connected to a matching circuit for outputting pulsating direct current voltage.

Further, the high frequency inverter is comprised of the switching elements composed of unipole elements, respectively. The use of MOSFETs for the unipole elements enables the switching operation at a drain efficiency of more than 90% in the frequency range of the present invention.

The secondary coil of the heating roller may have a structure wherein the secondary coil is coupled with the primary coil of the induction coil unit through the core-less transformer coupling or through a cored transformer coupling. Also, in case of the core-less transformer coupling, the secondary coil may have the secondary resistance value which is nearly equal to the secondary reactance of the secondary coil.

Now, the operation of the induction heating roller device is described below in detail.

Energizing the primary coil at the high frequency with the high frequency inverter using the MOSFETs for producing the high frequency of more than 1.1 MHz at a high conversion efficiency enables Q of the core-less coil to be increased. As a result, the primary coil may have a reduced amount of loss, thereby improving the electric power transmission efficiency with respect to the heating roller to be highly improved. However, if the output frequency is less than 1.1 MHz, then, it becomes difficult to obtain an adequately large Q and, thus, the presence of output frequency less than 1 MHz is not suited. In other word, a preferable frequency range of the high frequency is selected to be 1.5 to 6 MHz. Further, a more preferable frequency range of the high frequency is selected to be 2 to 4 MHz. Such a frequency range is also effective in the example shown in FIG. 5 for minimizing the switching loss of the MOSFETs while obtaining a high conversion efficiency.

According to a sixth aspect of the present invention, there is provided an induction heating roller device which comprises an induction coil unit having a primary coil with a midpoint thereof being connected to the ground, a hollow heating roller having a secondary coil coupled to the primary coil of said induction coil unit through a coreless transformer coupling and composed of a closed circuit, said secondary coil having a secondary resistance value substantially equal to a secondary reactance, said heating roller being rotatably supported, an electric power supply for energizing the primary coil of said induction heating coil unit, and a smoothing circuit interposed between said induction coil unit and said power supply unit.

The primary coil of the induction coil unit is inserted through the heating roller and, hence, a self-loss is internally confined in the heating roller. As a result, since the surface temperature of the primary coil increases, the primary coil is liable to be overheated. When the primary coil reaches the high temperature, a heat cycle following the conducting or non-conducting states of the induction coil unit is applied to the primary coil. Since, in this instance, the primary coil generally has an increased electric current capacity, the primary coil is comprised of a large size raw wire which is mechanically formed into a desired configuration. If, in such a case, the primary coil is exposed to the heat cycle, a distortion that would occur during a coil forming period is released, causing deformation of the primary coil to obtain a given electric characteristic.

According to the present invention, since the smoothing circuit is interposed between the induction coil unit and the electric power supply, a midpoint of the primary coil of the induction coil unit can be connected to the ground. Connecting the midpoint of the primary coil to the ground enables the heat of the primary coil to be escaped through the midpoint earth connection path. As such, the temperature rise of the primary coil is limited, resulting in a capability of providing a well-balanced temperature distribution in the primary coil.

The secondary coil of the heating roller may have a structure wherein it is coupled with the primary coil of the induction coil unit through the core-less transformer coupling or through the cored transformer coupling. Also, in case of the core-less transformer coupling, the secondary coil may be so arranged as to have the secondary resistance value nearly equal to the secondary reactance of the secondary coil.

According to a seventh aspect of the present invention, in addition to the feature of the heating roller device of the sixth aspect of the present invention, the heating roller device includes a heat transfer path formed by a midpoint earth connection path of the primary coil at only one side of the heating roller.

According to the present invention, although the heat transfer path using the midpoint earth connection path of the primary coil is limitedly provided at one side of the heating roller to compel the primary coil to have a lower thermal conductivity than that obtained in the primary coil provided at its both ends with the heat transfer paths, it is possible for the temperature of the primary coil to be lowered while eliminating leakage current. Also, the presence of the heat transfer paths formed at both ends of the heating roller compels it to have two mounting locations, inviting a new issue of increased leakage current.

The secondary coil of the heating roller may have a structure wherein it is coupled with the primary coil of the induction coil unit through the core-less transformer coupling or through the cored transformer coupling. Also, in case of the core-less transformer coupling, the secondary coil may be so arranged as to have the secondary resistance value nearly equal to the secondary reactance of the secondary coil.

According to a eighth aspect of the present invention, there is provided a induction heating roller device which comprises an induction coil unit including a core made of a body and a flange integral with at least one end of the body, which are made of magnetic material, and a primary coil wound around an outer circumferential periphery of said body, and a hollow heating roller including a secondary coil formed in a closed circuit and having a plurality of component layers, which are laminated into a concentric relationship, whose at least one layer is made of an electrically conductive, magnetic material, to allow the inductive coil unit to be internally inserted for permitting the electrically conductive, magnetic material to be coupled to the primary coil of the induction coil unit through a transformer coupling, the secondary coil having a secondary resistance value substantially equal to a secondary reactance.

The core may include a single piece of core component or a plurality of core components formed along an axial direction of the heating coil. Even in case of the primary coil comprised of the single piece of coil component, the single primary coil may be comprised of divided windings formed on a plurality of core components or may be comprised of a plurality of primary coil components which are wound around the plurality of core components, respectively, on a one to one basis. Dividing the core along the axis of the heating roller into the plural core components enables the core to be manufactured at a low cost while enabling the magnetic fluxes of the cores of the inner primary coil from being leaked outside from respective magnetic flux paths.

Further, the core may include a body portion that has either a rod shape or a cylindrical shape. The flange portion of the core may be held in contact with the inner surface of the heating roller or a small gap may be formed between the flange portion and the inner surface of the heating roller to be held in non-contact relationship. With a structure wherein the inner surface of the heating roller is formed with an electrically conductive magnetic material and the flange portion of the core of the induction coil unit is held in contact with the inner surface of the heating roller to allow the heating roller to rotate, the magnetic reluctance is further reduced, thereby further increasing the coil efficiency. On the contrary, with the flange portion of the core held in non-contact with the inner surface of the heating roller, the rotation of the heating roller is not disturbed for minimizing the load of a drive motor which drives the heating roller while eliminating the wear of the heating roller, with a resultant decrease in manufacturing cost of a whole structure of the induction heating roller device while improving a reliability.

Furthermore, bearing mechanisms and drive mechanisms for the heating roller may be located along the axis of the heating roller at the sides thereof in areas outside the ends of the flange portions of the core. As a consequence, the bearing mechanisms etc. is located outside the magnetic flux path such that the magnetic flux path can not be adversely affected from the bearing mechanisms etc. to form an optimum magnetic path.

The heating roller may be comprised of a plurality of laminated sheets of thin electrically conductive magnetic material, or may be composed of a single piece of magnetic material. In addition to the electrically conductive material, the plastic resin layer may be formed over an outermost surface of the heating roller. Also, the electrically conductive magnetic material may be wound around a roller shaped base body made of electrically non-conductive material.

Moreover, the core of the induction coil unit is designed to have a length shorter than that of the axial length of the heating roller to allow the bearing mechanisms of the heating roller to be located to the ends of the heating roller. With such an arrangement, the heating roller is able to have the maximum effective length.

According to the present invention, the primary coil is wound around the outer periphery of the body portion made of magnetic material and the outer periphery of the body portion of the core having the flange portion, with the flange portion of the core being relatively located in close proximity to the secondary coil of the heating coil. Also, the presence of the secondary coil made of magnetic material allows the magnetic flux path to have a reduced magnetic reluctance. For this reason, a strong magnetic field may be internally formed in the magnetic flux path, enabling the primary coil of the induction coil unit to have an increased inductance.

Consequently, it is possible for a desired magnetic field to be formed with a relatively small amount of exciting current for thereby improving a coil efficiency.

According to a ninth aspect of the present invention, there is provided a heating roller for an induction heating roller device, said heating roller comprising a hollow roller base body made of electrically non-conductive material, and a plurality of secondary coil components composed of respective closed circuits circumferentially wound around said roller base body and distributed along an axis of said roller base body.

The roller base body is made of electrically non-conductive material such as ceramic, glass and other heat resisting plastic resin and has an internal hollow space. The hollow space is designed to have an adequate size to allow the induction coil unit to be internally received. Moreover, since the roller base body serves to take charge of a desired mechanical strength of the heating roller, the roller base body may be preferably designed to have a suitable thickness taking the strength of material forming the same into consideration.

The secondary coil may be formed either in one of the internal surface and the outer surface of the base body or in both the same. Further, the secondary coil may be formed of a single piece of secondary coil component or a plurality of secondary coil components. In addition, in case of the secondary coil composed of the plurality of secondary coil components, the plural secondary coil components may be located in a position to intersect the axis of the heating roller or in a plane to be slanted to the axis of the heating roller, i.e. in a condition to allow the axis of the heating roller and the axis of the secondary coil to intersect with respect to one another. With a structure in a latter case, the distance between the secondary coil components is shortened, with a resultant capability in uniformly heating the heating roller. Moreover, the presence of the secondary coil located in an overlapped relationship with the primary coil enables the coupling coefficient reduction to be limited to a relatively small value.

Further, the heating roller of the induction heating roller device according to the present invention may also be applied to the induction heating roller device discussed with reference to the first aspect and the eight aspect of the present invention.

Thus, in general, the base body made of electrically non-conductive material has a smaller thermal capacity than that made of metal such as iron, resulting in a reduced time period required for heating. Moreover, in case of fixed heat source, since the time period required for heating is determined by the product of the heat resistance and the heat capacity, the smaller the heat capacity, the shorter will be the time period required for heating. For example, in the related art practice, the heating roller includes the base body which is made of iron in the related art practice. In this connection, supposing that iron has a heat capacity of 100, soda glass and aluminum ceramic have the heat capacities of 58 and 87, respectively, either of which remains at a relatively small heat capacity level. Thus, the presence of the base body made of electrically non-conducting material enables the time period required for heating the heating roller to be shortened.

It will thus be appreciated that, according to the present invention, the induction heating roller device enabling the shortened warm-up heating time period can be obtained.

A heating roller of a tenth aspect of the present invention for the induction heating roller device of the ninth aspect of the present invention features that the secondary coil is located over an outer circumferential periphery of the roller base body.

The presence of the secondary coil formed over an outer periphery of the base body provides an ease of forming the secondary coil on the base body. That is, a desired secondary coil pattern can be formed with a plurality of secondary coil components which are electrically insulated from one another. Alternatively, the desired secondary coil can be made of a metallic foil which is stick to the base body.

Further, the heating roller for the induction heating roller device according to the present invention may be applied to the induction heating roller device of either one of the induction heating roller of the first to eight aspects of the present invention.

A heating roller of an eleventh aspect of the present invention for the induction heating roller device of the ninth or tenth aspects of the present invention features that each of a plurality of secondary coil components includes a coil component of a single turn.

Further, the heating roller for the induction heating roller device of the present invention may be applied to the induction heating roller device of either one of the first to eighth aspects of the present invention.

The presence of the secondary coil component made of single turn allows a periphery of the heating roller to be merely covered with a conductor with a suitable resistance which is formed in a ring shape, thereby making it possible to form a closed circuit of the secondary coil having a given secondary resistance value. In case of the secondary coil composed of the single piece of coil component having the single turn, the secondary coil is allowed to have a width covering a whole effective length of the heating roller along an axis thereof. Further, when forming the plurality of secondary coil components on the heating roller, it may be possible to select the number of secondary coil components, a width of each secondary coil component and a mounting pitch of the secondary coil component in respective suitable values such that the temperature of the heating roller is distributed along an axis thereof in a level as uniform as possible and the secondary coil has a desired secondary coil resistance value.

A heating roller of a twelfth aspect of the present invention for the induction heating roller device of the ninth aspect of the present invention features that a thermal conducting element extends across the plurality of secondary coil components and coupled thereto in thermally conductive relationship.

With such a structure according to the present invention, heat is transferred in dependence on the temperature gradient among the plurality of secondary coil components via the thermal conducting element extending across the plurality of secondary coil components. As a consequence, it is possible for uneven temperature distribution among the plurality of secondary coil components to be effectively eliminated.

The secondary coil may be comprised of single turn or more than single turn. In a latter case, if the thermal conducting element has a structure wherein it is thermally coupled to a plurality of points of the secondary coil of single turn, the thermal conducting element may be composed of electrically non-conductive material.

The thermal conducting element may be connected to a single point or a plurality of points of the periphery of the heating roller. Further, the width of the thermal conducting element may be formed in a smaller value than that of the secondary coil. With such a structure, it is possible for inductive current flowing through respective secondary coil components to be easily limited, thereby enabling leakage of electric current between the adjacent secondary coil components from being eliminated for providing an ease of design of the electric power transmission circuit between the primary and secondary coils.

Thus, the present invention enables uneven temperature distribution among the secondary coil components to be effectively eliminated, thereby eliminating uneven temperature distribution in the surface of the heating roller.

A heating roller of a thirteenth aspect of the present invention for the induction heating roller device of the twelfth aspect of the present invention features that the thermal conducting element includes an electrically conductive element.

The presence of the thermal conducting element made of electrically conductive element enables a decrease in an electric potential difference between adjacent points, of the plurality of secondary coil components, to which the electrically conductive element is connected. Consequently, since the reference electric potentials among the respective secondary coil components can be equalized, it becomes easy for a distribution capacity between the respective secondary coil components and the ground to be determined.

Further, the thermal conducting element can be formed with the same material as that of the secondary coil. As a result, the thermal conducting element can be fabricated in an easy manner.

Thus, the present invention makes it easy for the secondary electric current to flow through the respective secondary coils in an equal level, thereby enabling heat to uniformly develop in the respective secondary coil components.

Furthermore, the presence of the distribution capacity that is easy to be managed makes it possible for leakage current to be eliminated.

According to a fourteenth aspect of the present invention, there is provided a heating roller for an induction heating roller device, said heating roller comprising a hollow roller base body made of electrically insulating material, and a plurality of secondary coil components composed of respective closed circuits circumferentially wound over a whole surface of said roller base body along an axis of said roller base body.

The roller base body may be formed of a cylindrical body made of glass.

The secondary coil may be formed by an electrically conductive film formed over an entire surface of an inner wall of the base body. In summary however, the secondary coil may be formed on not only the inner wall of the base body but also the outer wall of the base body.

Thus, the present invention makes it possible to obtain the heating roller which is simple in construction.

A heating roller of a fifteenth aspect of the present invention for the induction heating roller device of the ninth aspect of the present invention features that the secondary coil components are formed by electrically conductive films, respectively.

The electrically conductive films may be formed in deposition of electrically conductive material, chemical adhesion, stick of an electrically conductive foil and a thick film structure of electrically conductive material.

In such a manner, the present invention enables the secondary coil to be thinned.

A fixing apparatus of a sixteenth aspect of the present invention features the provision of a fixing frame body including a pressure roller, and an induction heating roller device of the first aspect of the present invention wherein a heating roller is held in pressured contact with the pressure roller to allow record medium, which is adhered with toner image, to be transferred through the both rollers for thereby causing the toner image to be fixed to said record medium.

A fixing apparatus of a seventeenth aspect of the present invention features the provision of the ninth aspect of the present invention wherein a heating roller is held in pressured contact with the pressure roller to allow record medium, which is adhered with toner image, to be transferred through the both rollers for thereby causing the toner image to be fixed to said record medium.

In a description of the present invention, the "fixing frame body" refers to a remaining structural portion which is left after removing the heating roller of the inductive heating device or the inductive heating roller device from the fixing apparatus.

The pressure roller and the heating roller may be held in directly pressured contact with one another or may be held in indirectly pressured contact with one another via a transfer sheet. Also, the transfer sheet may have an endless or roll shape.

Thus, the present invention enables the record medium, which is formed with the toner image, to be transferred between the heating roller and the pressure roller to allow the toner image to be fixed onto the record medium.

An image forming apparatus of an eighteenth aspect of the present invention features the provision of an image forming frame body including an image forming unit for forming toner image on record medium, and a fixing unit mounted in the image forming frame body of the sixteenth aspect of the present invention for causing toner image to be fixed to record medium.

An image forming apparatus of a nineteenth aspect of the present invention features the provision of an image forming frame body including an image forming unit for forming toner image on record medium, and a fixing unit, of the seventeenth aspect of the present invention, mounted in the frame body for causing toner image to be fixed to record medium.

In a description of the present invention, the "image forming frame body" refers to a remaining portion of the image forming apparatus from which the fixing apparatus is removed. Also, the image forming unit is comprised of a structure for forming image onto the record medium responsive to image information in an indirect image forming system or a direct image forming system. Moreover, the "indirect image forming system" refers to a system wherein image is formed by a transfer technology.

The image forming apparatus involves an electrophotograph copying machine, a printer and a facsimile.

The record medium involves a transfer material sheet, a print sheet, an electro-facsimile sheet and an electrostatic record sheet, etc.

Thus, the present invention allows the induction heating roller device of the first aspect of the present invention or the induction heating roller device of the ninth aspect of the present invention to include the heating roller to provide the image forming apparatus which is able to shorten the warm-up time interval.

DETAILED DESCRIPTION OF THE PREFERRED EMBODIMENTS

Figure 8B:
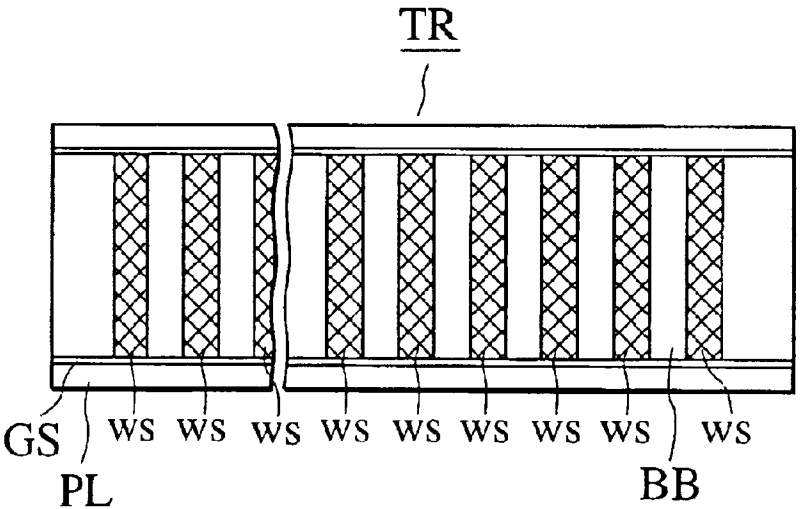
FIG. 8 is an exploded front view of the induction heating roller device, with partly in cross section, of a first preferred embodiment according to the present invention.
Figure 8A:
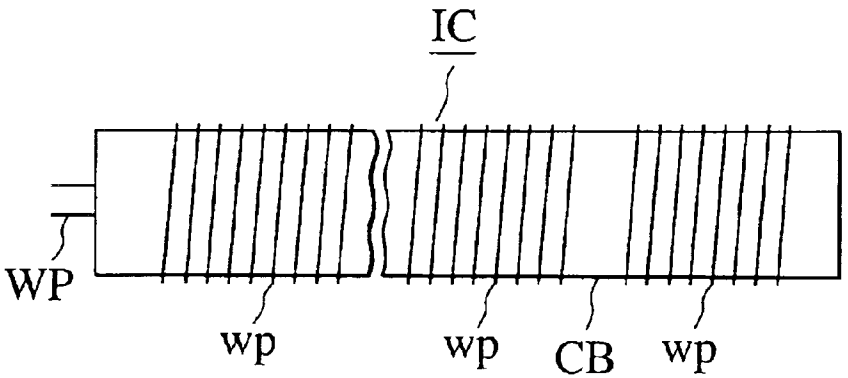
Figure 9:
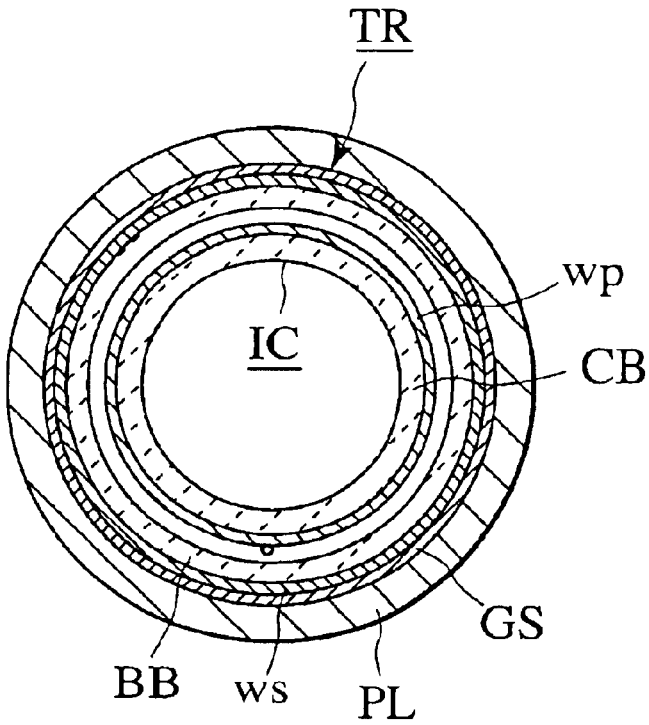
FIG. 9 is an enlarged cross sectional view of the induction heating roller device of the first preferred embodiment according to the present invention.
Figure 10:
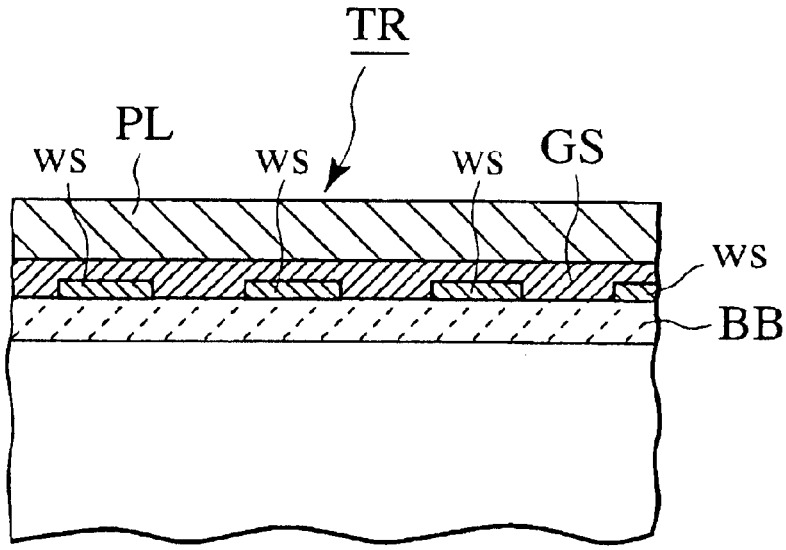
FIG. 10 is an enlarged, longitudinal cross sectional view illustrating an essential part of a heating roller shown in FIG. 9.

To describe the present invention more in detail, an induction heating roller device of a preferred embodiment according to the present invention will be described below in detail in conjunction with FIGS. 8 to 10, wherein FIG. 8 is an exploded view, partly in cut away, of the induction heating roller device of a first preferred embodiment according to the present invention. FIG. 9 is an enlarged transverse cross sectional view of an induction heating roller. FIG. 10 is an enlarged longitudinal cross sectional view of an essential part of the heating roller shown in FIG. 9.

Figure 1:
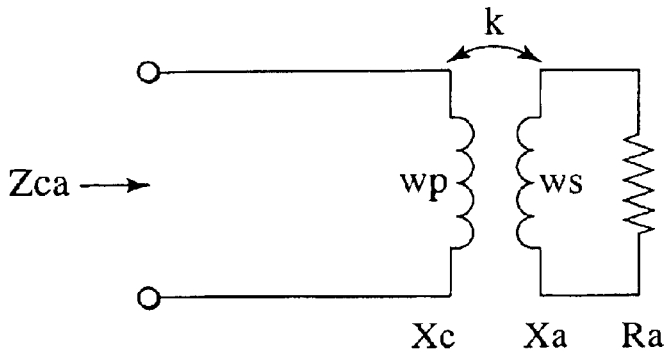
FIG. 1 is a view illustrating an equivalent circuit for an induction heating roller device according to the present invention.
Figure 2:
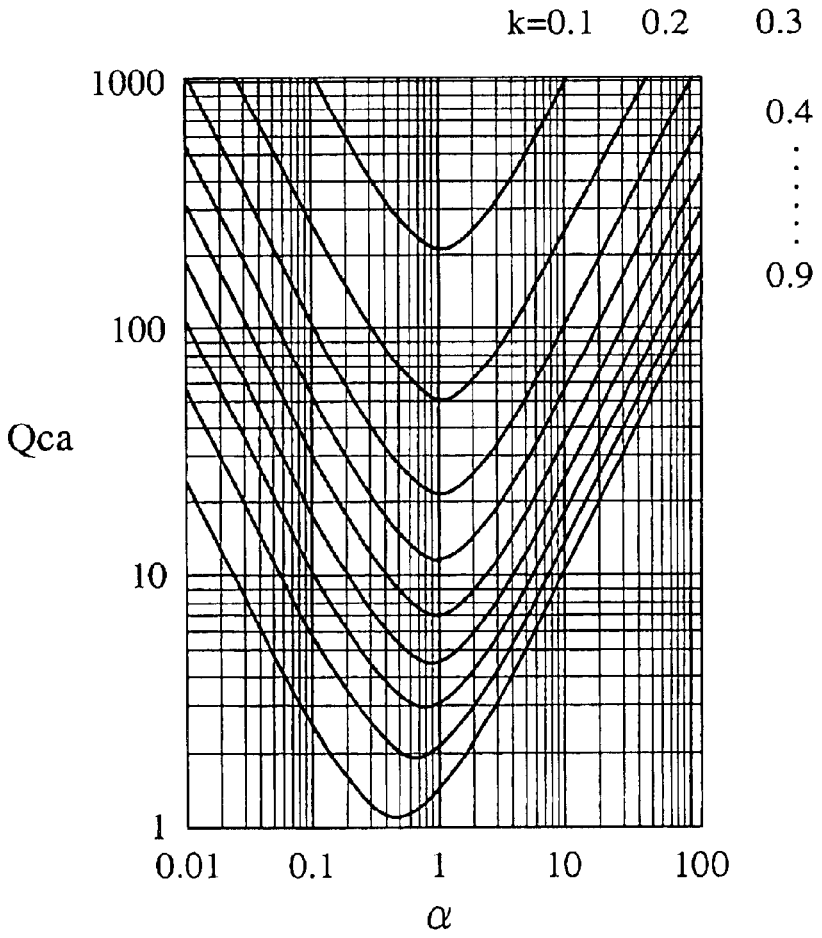
FIG. 2 is a graph showing the relationship between $\alpha$ and $Q_{ca}$ for each coupling coefficient for illustrating an operating principle of the induction heating roller device according to the present invention.
Figure 3:
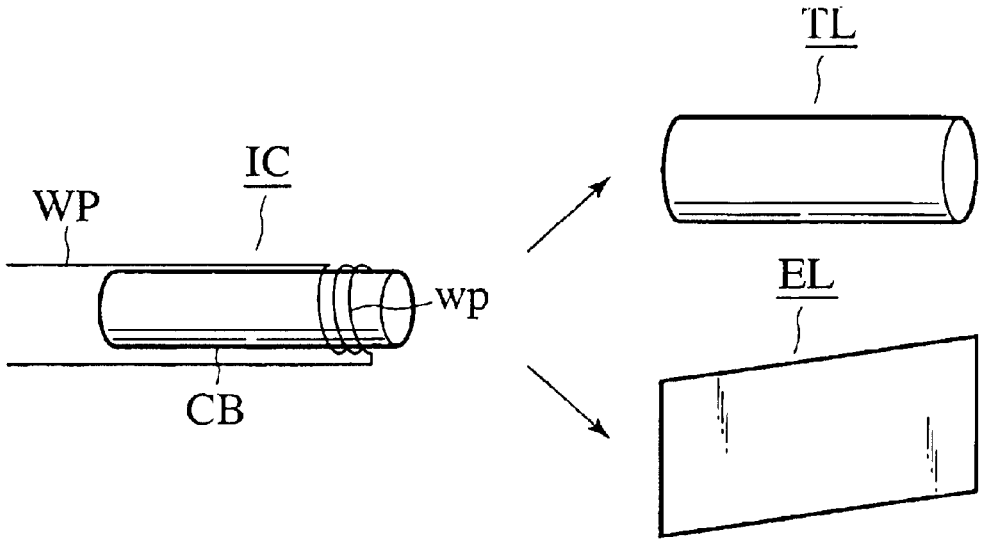
FIG. 3 is a schematic view illustrating a measuring system of a preliminary test for confirming the operating principle of the induction heating roller device according to the present invention.
Figure 4:
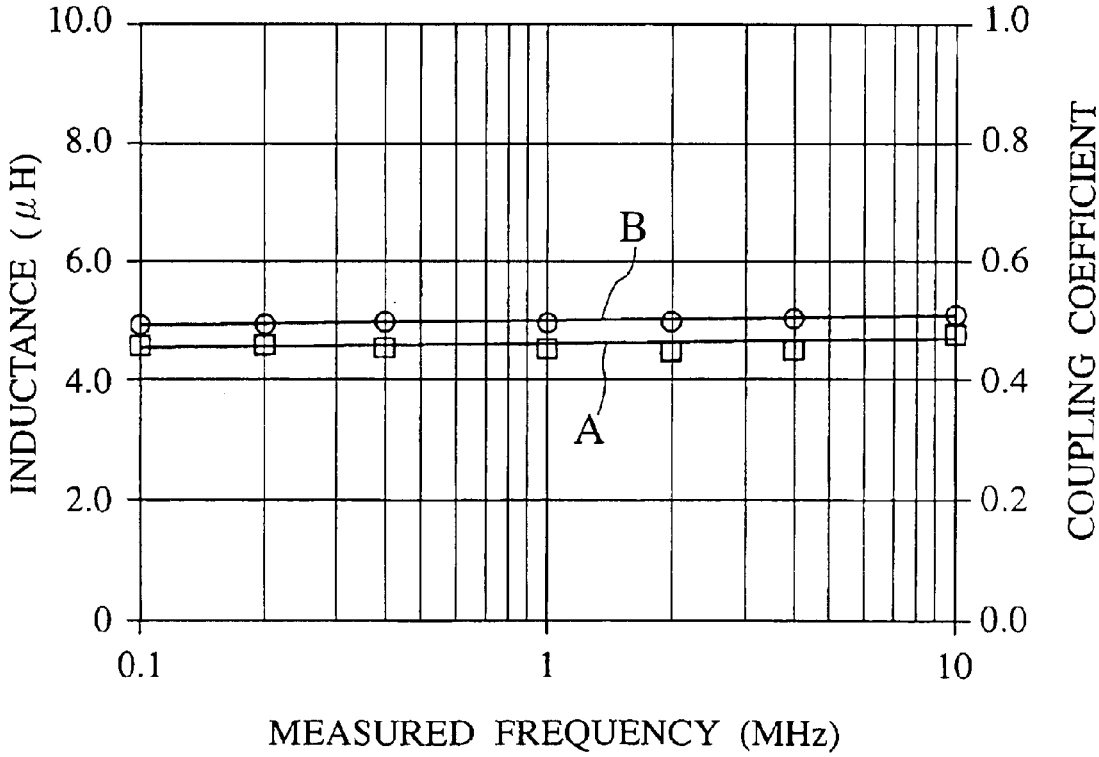
FIG. 4 is a graph illustrating variations of inductance and the coupling coefficient in terms of a measured frequency of the primary coil during non-mounting of a load in the preliminary test for confirming the operating principle of the induction heating roller device according to the present invention.
Figure 5:
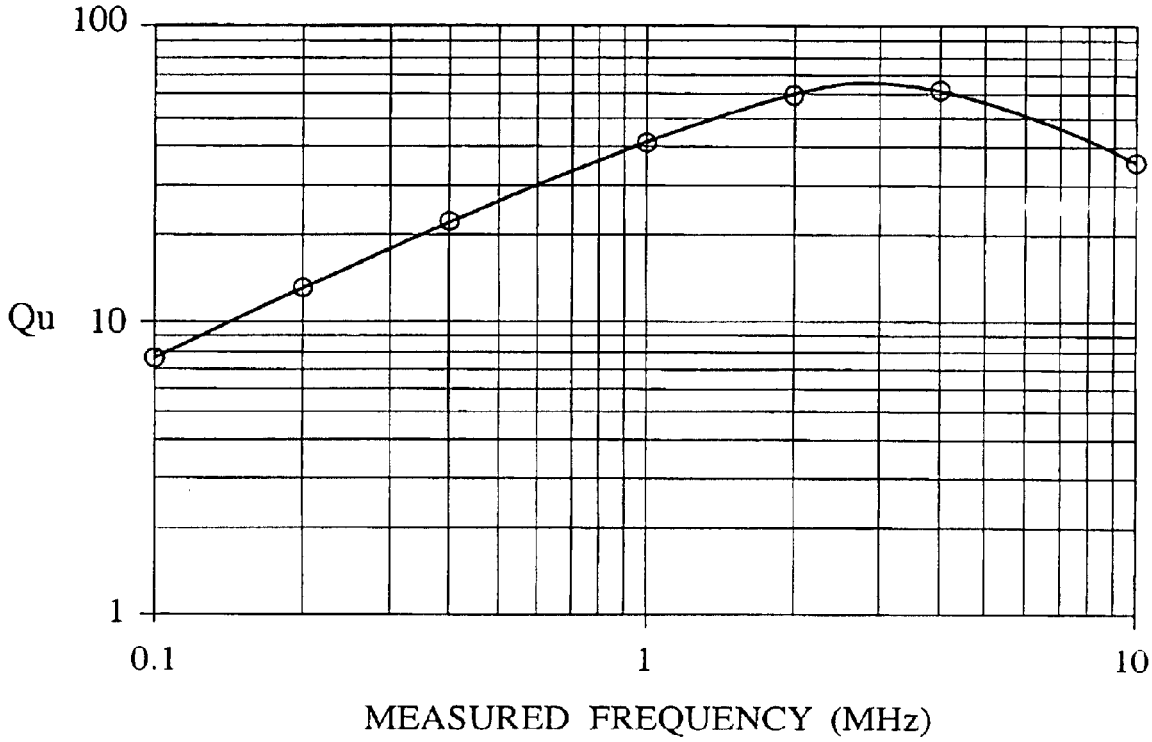
FIG. 5 is a graph illustrating a variation of $Q_U$ of the primary coil during non-mounting of a load in the preliminary test for confirming the operating principle of the induction heating roller device according to the present invention.
Figure 6:
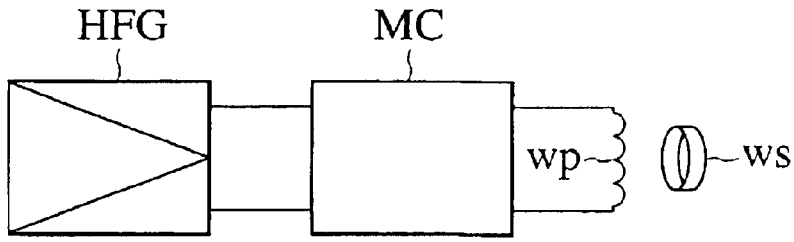
FIG. 6 is a schematic view showing a measuring system for the temperature rise of a secondary coil of the induction heating device according to the present invention.
Figure 7:
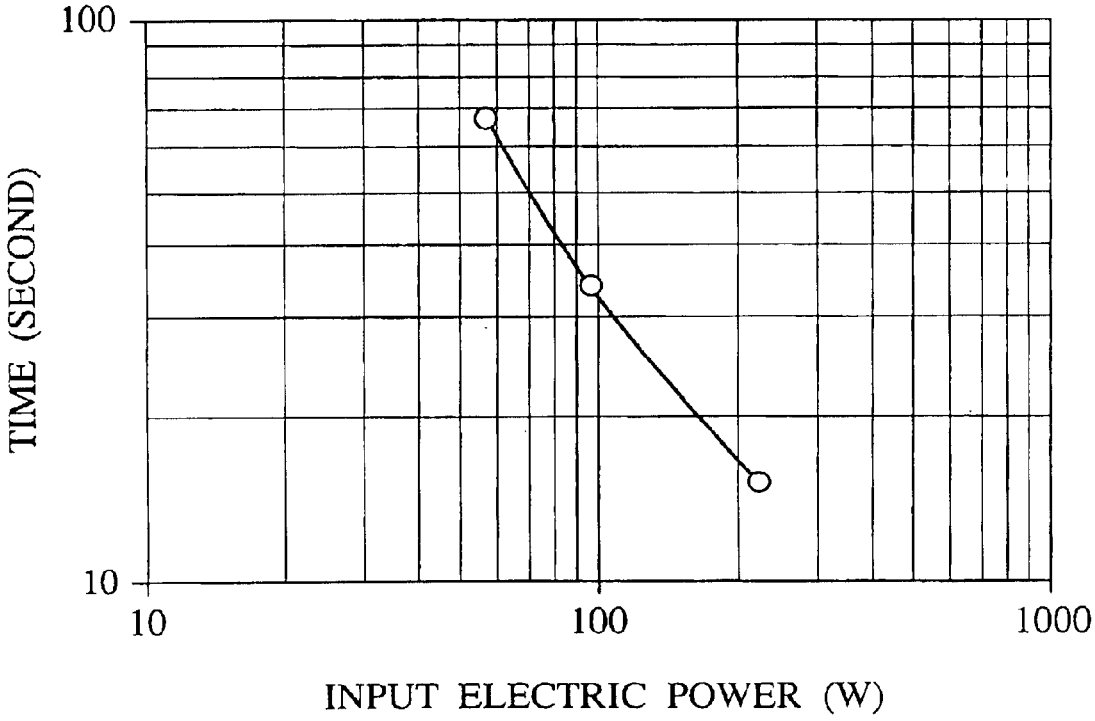
FIG. 7 is a graph showing a measured result of the temperature rise of the secondary coil of the induction heating device according to the present invention.

In FIGS. 8 to 10, like component parts bear the same reference numerals as those used in FIG. 3 and a detailed description of the same is herein omitted for the sake of simplicity. In the presently filed preferred embodiment, the induction coil unit device IC includes a primary coil composed of a plurality of primary coil components wp, and the heating roller TR includes a secondary coil composed of a plurality of secondary coil components ws, with the secondary coil components ws being formed on an outer circumferential wall of a base body BB.

In the induction heating coil device IC, the plural primary coil components wp are separately formed in a plurality of groups over an outer circumferential wall of a bobbin CB and connected to a wire pair WP in a parallel relationship with respect to one another.

The heating roller TR is comprised of a non-conductive roller base body BB, the plurality of secondary coil components ws, a glass sealing layer GS and a plastic resin layer PL. The non-conductive roller base body BB is comprised of a cylindrical body, which has an outer diameter of 30 mm and is made of aluminum ceramic material. Each of the plurality of secondary coil components ws is made of a thick film copper conductor with a width of 1 mm and is formed over the roller base body BB in a ring shape to form a single turn in a closed circuit. When the primary coil components wp are applied with a high frequency of 3 MHz, the secondary coil components ws have an inductance of 60 nH with a secondary resistance value R of 1.2 Ω. From this value, it is settled that the value of $\alpha=R_a/X_a$ equals about 1. The thick film copper conductors are formed by carrying out screen printing of paste-like conductive material, primarily made of copper, over the surface of the base body BB, drying the copper conductors and baking the dried conductors to obtain final products. The glass sealing layer GS is formed over the base body BB above the secondary coil components ws for sealing between the secondary coils ws and the base body BB. The plastic resin layer PL is made of fluorine plastic resin covered on the glass sealing member GS. It is to be noted here that the heating roller has bearing mechanisms, for rotation, of a related art structure, and a detailed description of the same is herein omitted.

Figure 11:
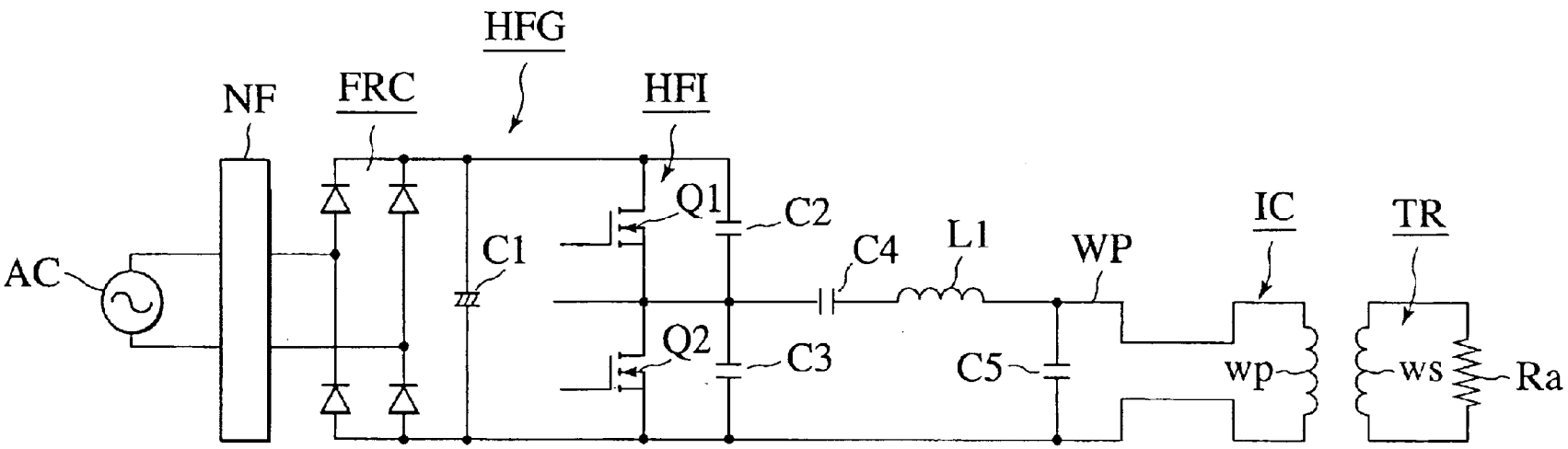
FIG. 11 is a circuit diagram illustrating an induction coil unit of a second preferred embodiment according to the present invention.

FIG. 11 is a circuit diagram illustrating an induction coil unit of a second preferred embodiment according to the present invention.

In FIG. 11, the circuitry includes a low frequency alternating current power supply AC, a high frequency alternating current power supply HFG, the induction coil unit IC and the heating roller TR.

The low frequency alternating current power supply is composed of a commercially available alternating current power supply of 100 volts.

The high frequency alternating current power supply HFG is comprised of a noise filter NF, a full-wave rectification circuit FRC, a smoothing capacitor C1 and a half-bridge type high frequency inverter HF1. The noise filter NF serves to absorb high frequency noises that occur during switching operation of the high frequency inverter HF1 for thereby avoiding the high frequency noises from flowing into the low frequency alternating current power supply SC. The full-wave rectification circuit FRC serves to rectify the low frequency alternating current into pulsating direct current to be output. The smoothing capacitor $C_1$ converts the pulsating direct current into smoothed direct current. The half-bridge type high frequency inverter HF1 includes a pair of switching elements $Q_1$, $Q_2$, a pair of capacitors $C_2$, $C_3$ and a series connected resonating circuit composed of an inductor $L_1$ and a capacitor $C_4$. The pair of switching elements $Q_1$, $Q_2$ are comprised of MOSFETs which are connected in series between both terminal ends of the smoothing capacitor $C_1$. The smoothing capacitors $C_2$, $C_3$ are connected to the switching elements $Q_1$, $Q_2$ in parallel to one another. The inductor $L_1$ and the capacitor $C_4$ are connected to the terminal ends of the switching element $Q_2$ and load in series to form a series connected resonating circuit.

The induction coil device IC includes the primary coil components wp and the capacitor $C_5$ which are connected in parallel.

The heating roller TR includes the secondary coil components ws. Also, reference numeral $R_a$ designates an equivalent secondary resistance.

With such a high frequency inverter circuit HF1, an output frequency of 3 MHz appears at both terminals of the switching element $Q_2$, causing the series connected resonating circuit composed of the inductor $L_1$ and the capacitor $C_4$ to apply the sine wave high frequency voltage of 3 MHz to the induction coil device IC. The presence of the induction coil device IC composed of the primary coil components wp and the capacitor $C_5$ connected thereto in parallel allows a power factor to be improved.

Figure 12:
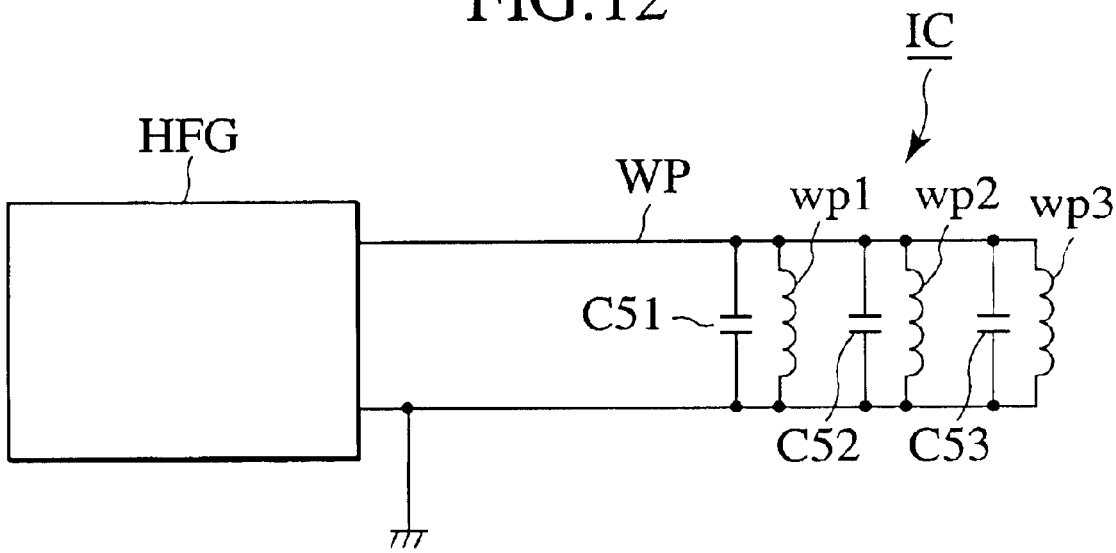
FIG. 12 is a circuit diagram illustrating an induction coil unit of a third preferred embodiment according to the present invention.

FIG. 12 is a circuit diagram of an induction coil unit of a third preferred embodiment according to the present invention.

In the third preferred embodiment, the induction coil unit is comprised of a plurality of primary coil components $wp_1$, $wp_2$, $wp_3$, and a plurality of capacitors C51, C52, C53 which are connected between the wire pair WP in the vicinities of the respective primary coils.

Figure 13:
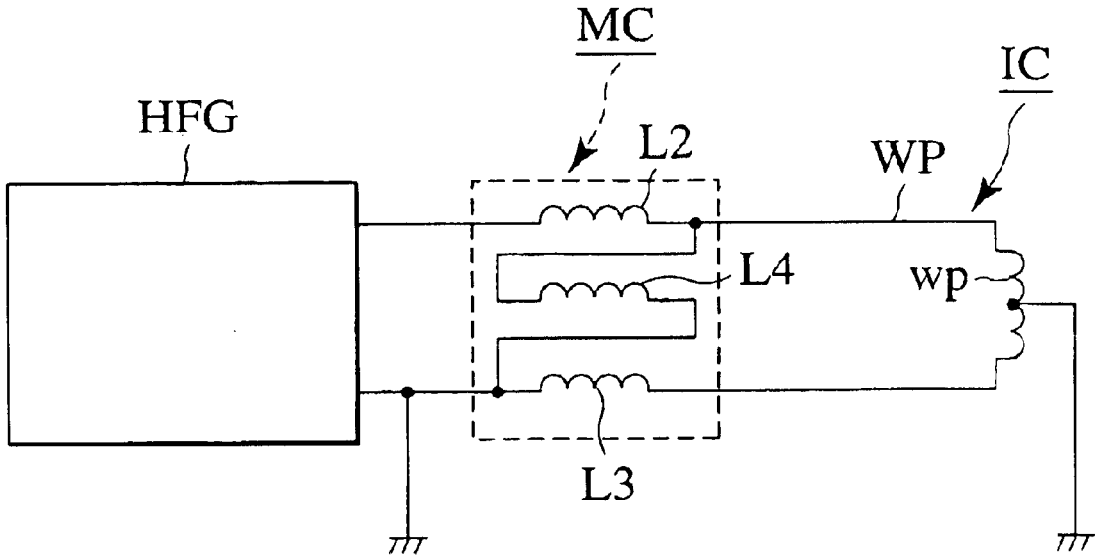
FIG. 13 is a circuit diagram illustrating an induction coil unit of a fourth preferred embodiment according to the present invention.

FIG. 13 is a circuit diagram of an induction coil unit of a fourth preferred embodiment according to the present invention.

In the fourth preferred embodiment, the induction coil device is comprised of a smoothing circuit MC which is connected between the high frequency power supply HFG and the induction coil device IC. The smoothing circuit MC is comprised of inductors $L_2$, $L_3$ which are connected to the wire pair WP in series, and an inductor $L_4$ which is connected between a load side of the inductor $L_2$ and a terminal, at the high frequency power supply HFG, of the inductor $L_3$ to be magnetically coupled to the inductors $L_2$, $L_3$.

In the induction coil device IC, a middle point of the primary coil wp is connected to the ground.

Figure 14:
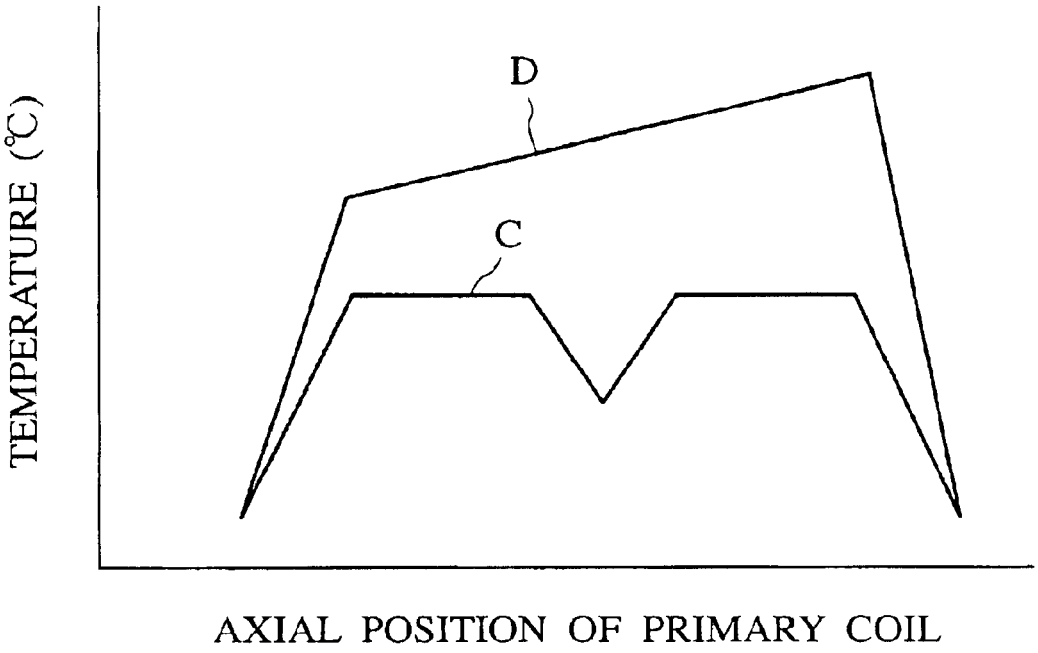
FIG. 14 is a conceptional graph illustrating a temperature distribution, together with a temperature distribution of a comparison example, which varies along an axis of the primary coil of the fourth preferred embodiment.

FIG. 14 is a conceptional graph illustrating the relationship between the temperature distribution characteristic, varying along an axis of the primary coil forming part of the induction coil device of the fourth preferred embodiment, and the temperature distribution characteristic of comparison example.

In FIG. 14, the abscissa axis indicates the position of the primary coil in an axial direction thereof, and the axis of ordinates indicates the temperature. The curve C is plotted for illustrating the temperature variation occurring in the present invention, and the curve D illustrates the temperature variation of the comparison example. Also, it is to be noted that the comparison example has the same specification as the circuit of the fourth preferred embodiment except for the mid point being connected to the ground.

As will be appreciated from the graph of FIG. 14, the present invention compels the heat created in the mid point of the primary coil to be conducted outward to the ground through an earth connection path, with a resultant reduction in temperature that is relatively distributed in an equalized fashion.

Figure 15:
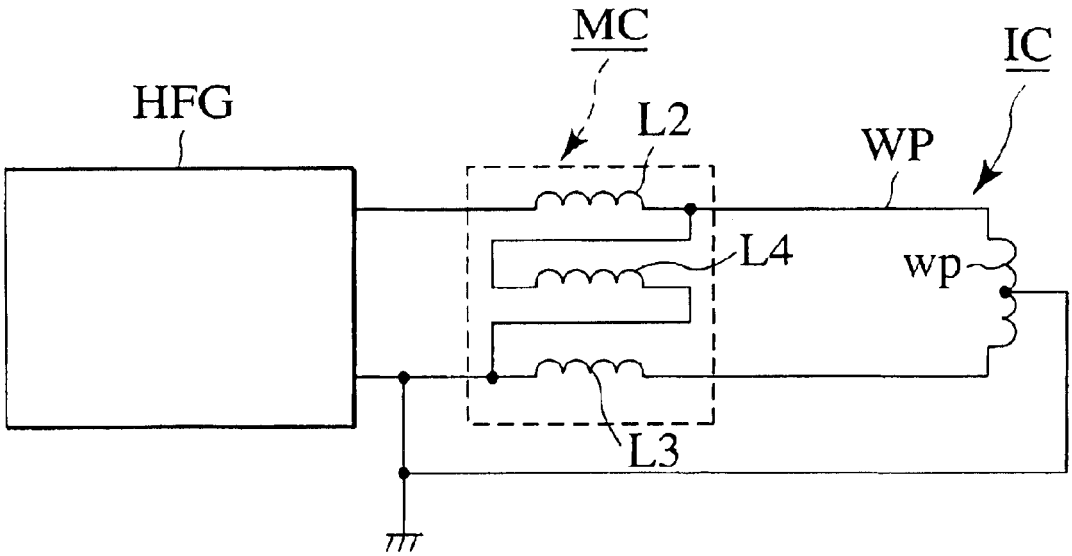
FIG. 15 is a circuit diagram illustrating an induction coil unit of a fifth preferred embodiment according to the present invention.

FIG. 15 is a circuit diagram of an induction coil device of a fifth preferred embodiment according to the present invention.

The fifth preferred embodiment differs from the fourth preferred embodiment shown in FIG. 13 in that both the mid point of the primary coil wp and the one terminal, at the side of the high frequency power supply HFG, of the inductor $L_3$ connected to the wire pair WP are connected to the ground.

Induction coil devices of other preferred embodiments according to the present invention will now be described below with reference to FIGS. 16 to 22, with like parts bearing the same reference numerals as those used in FIGS. 8 to 10.

Figure 16:
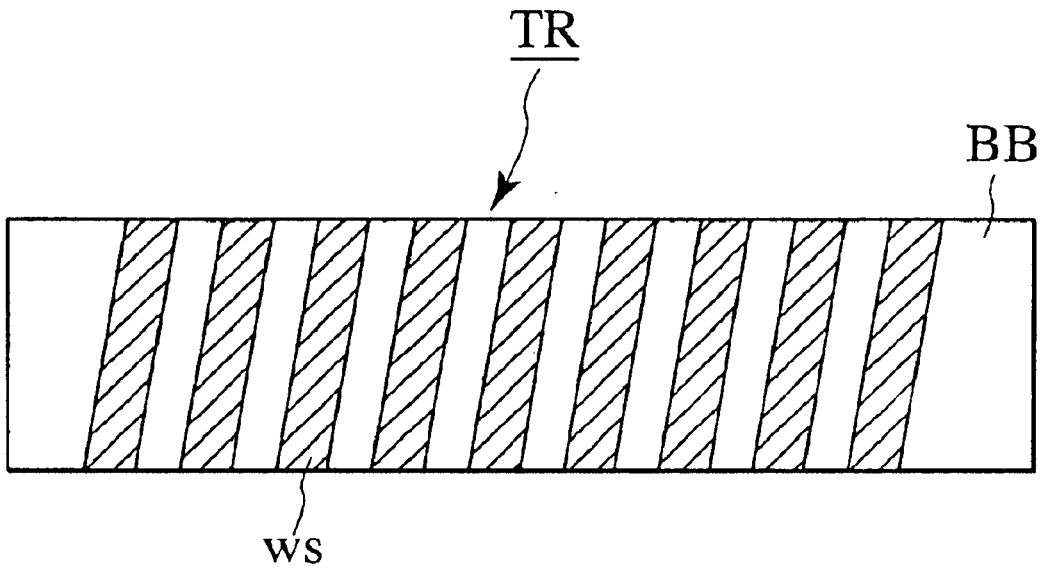
FIG. 16 is a front view, with partly cutaway, of a heating roller of an induction coil unit of a sixth preferred embodiment according to the present invention.

FIG. 16 is a front view of a heating roller TR of the induction coil device of the sixth preferred embodiment.

In the sixth preferred embodiment, the heating roller TR includes a secondary coil ws which is formed on the outer wall of the base body BB while compelling the axis of the secondary coil ws to intersect the axis of the heating roller TR. Also, the glass sealing layer and the plastic resin layer are herein omitted for the sake of simplicity.

Figure 17:
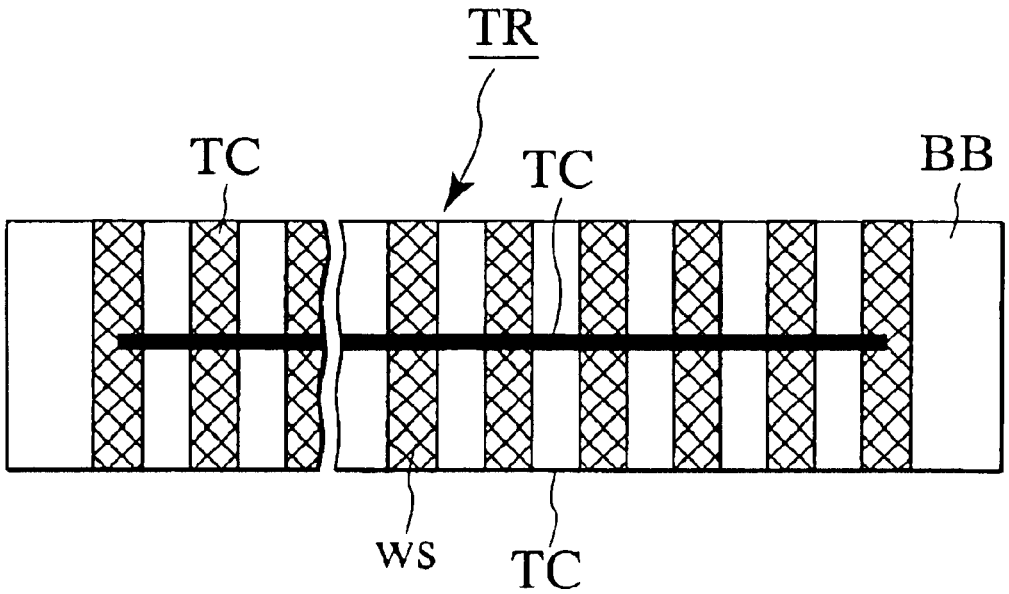
FIG. 17 is a front view of a heating roller of an induction coil unit of a seventh preferred embodiment according to the present invention.

FIG. 17 is a front view of a heating roller TR of the induction coil device of a seventh preferred embodiment according to the present invention.

In the seventh preferred embodiment, the heating roller TR includes a plurality of heat conductive elements TC extending over the plural secondary coils ws. Each of the thermal conductor elements TC is made of electrically non-conductive material and is formed over plural areas in the circumferential periphery of each secondary coil component ws. Also, the glass sealing layer and the plastic resin layer are herein omitted for the sake of simplicity.

Figure 18:
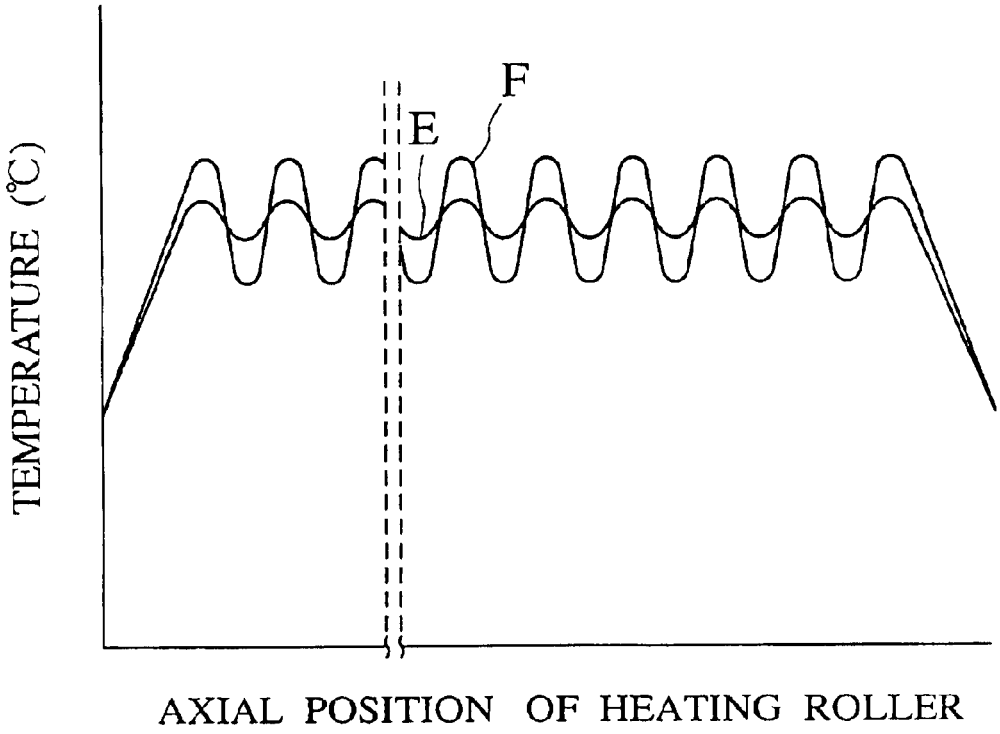
FIG. 18 is a conceptional graph illustrating a temperature distribution, together with a temperature distribution of a comparison example, of the heating roller of thee induction coil unit of the seventh preferred embodiment according to the present invention.

FIG. 18 is a graph illustrating the relationship between the temperature distribution characteristic, varying along an axis of the heating roller forming part of the induction coil device of the seventh preferred embodiment, and the temperature distribution characteristic of comparison example.

In FIG. 18, the abscissa axis indicates the position of the heating roller in an axial direction thereof, and the axis of ordinates indicates the temperature. The curve E shows the temperature variation occurring in the present invention, and the curve F illustrates the temperature variation of the comparison example. Also, it is to be noted that the comparison example has the same specification as the circuit of the seventh preferred embodiment except for the plural heat conductive elements.

As will be appreciated from the graph of FIG. 18, the present invention allows the temperature distribution along the axis of the heating roller TR to be relatively equalized.

Figure 19:
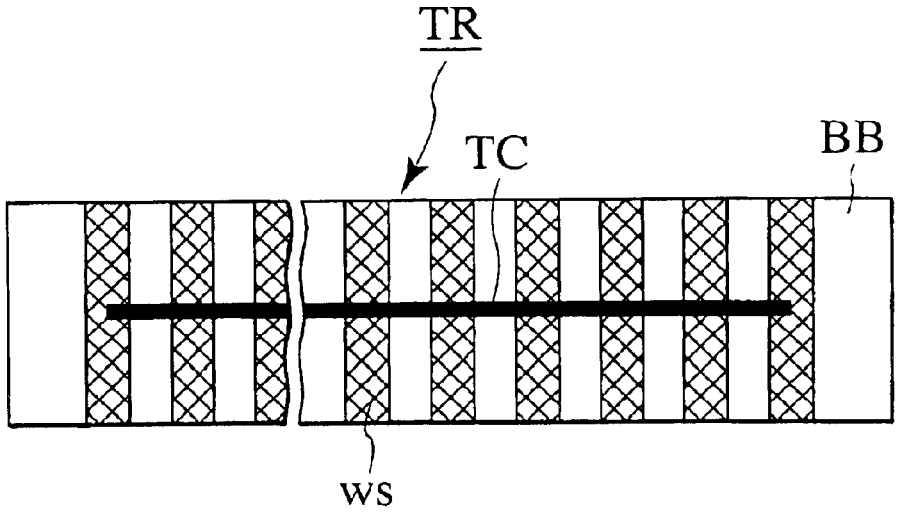
FIG. 19 is an enlarged front view illustrating an essential view of an induction coil unit of an eighth preferred embodiment according to the present invention.

FIG. 19 is a partly cut out, front view of a heating roller TR of an induction coil unit of an eighth preferred embodiment according to the present invention.

In the eighth preferred embodiment, the heating roller TR includes a heat conductive element TC extending over the plural secondary coils ws. The thermal conductor element TC is made of electrically conductive material and is formed over plural areas in the circumferential periphery of each secondary coil component ws. Also, the glass sealing layer and the plastic resin layer are herein omitted for the sake of simplicity.

Figure 20:
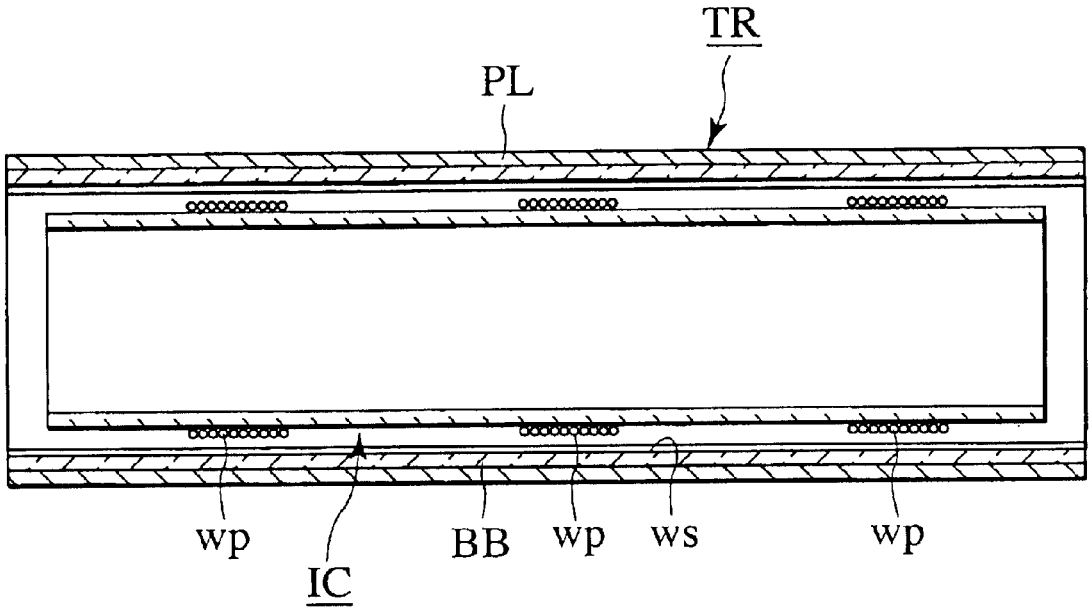
FIG. 20 is a longitudinal cross sectional view illustrating an induction coil unit of a ninth preferred embodiment according to the present invention.

FIG. 20 is a longitudinal cross sectional view of an induction coil unit of a ninth preferred embodiment according to the present invention.

In the ninth preferred embodiment, the induction coil unit is comprised of a heating roller which includes a roller base body BB made of cylindrical glass, a secondary coil ws formed by electrically conductive film coated over an entire surface area along an effective length in an axial direction of an inner wall of the roller base body BB, and a plastic resin layer PL formed over an outer wall of the base body BB. Also, it is to be noted that the electrically conductive film is made of transparent ITO film.

Figure 21:
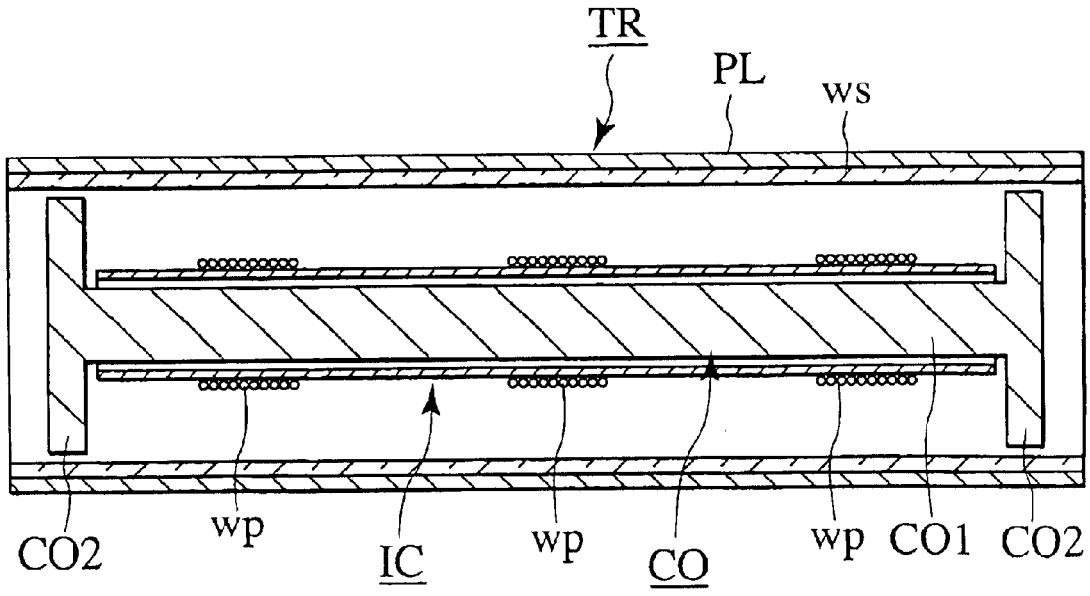
FIG. 21 is a longitudinal cross sectional view illustrating an induction coil unit of a tenth preferred embodiment according to the present invention.

FIG. 21 is a longitudinal cross sectional view of an induction coil unit of a tenth preferred embodiment according to the present invention.

In the tenth preferred embodiment, the induction coil unit IC is comprised of a core CO and a plurality of primary coil components wp formed thereon, with the secondary coil ws being composed of electrically conductive and magnetic material.

The core CO is made of ferrite and includes a cylindrical body $CO_1$ and flanges $CO_2$ integrally formed at both ends thereof. Each of the primary coil components wp is wound around the outer circumferential periphery of the cylindrical body CO1 via a bobbin CB. The flanges CO2 have outer circumferential peripheries located close proximity to an inner circumferential periphery of the secondary coil ws of the heating roller TR.

The heating roller TR includes the secondary coil which is comprised of a cylindrical body made of iron and which has an outer circumferential periphery coated with a plastic resin layer PL.

Figure 22:
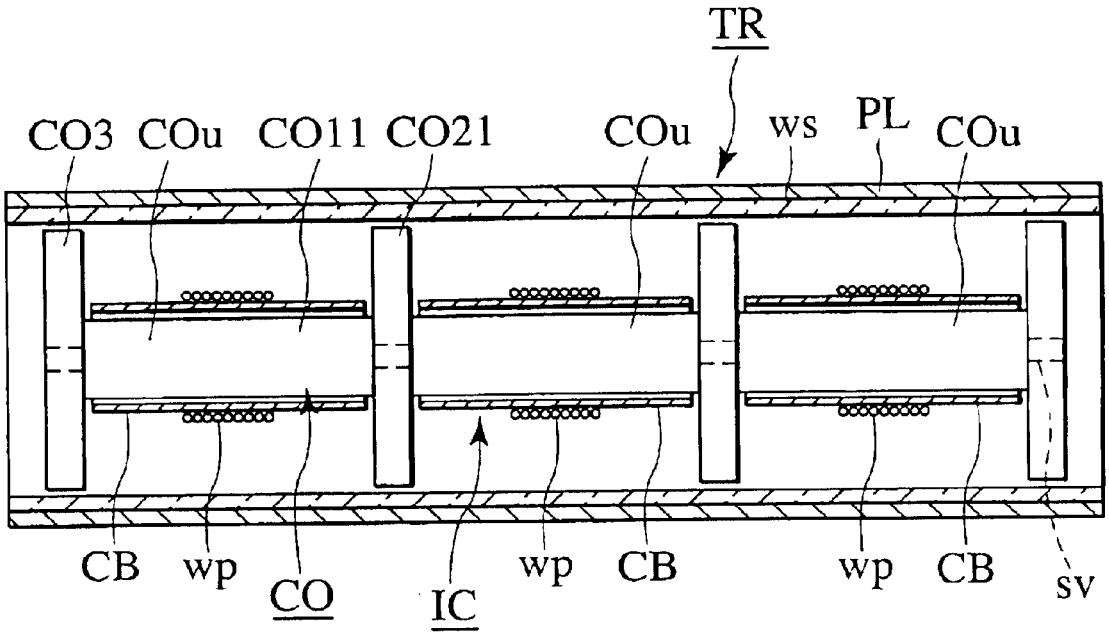
FIG. 22 is a longitudinal cross sectional view illustrating an induction coil unit of an eleventh preferred embodiment according to the present invention.

FIG. 22 is a longitudinal cross sectional view of an induction coil unit of an eleventh preferred embodiment according to the present invention.

In the eleventh preferred embodiment, the induction coil unit IC is formed into a plurality of divided component elements.

In particular, the core CO is comprised of a plurality of unit cores $CO_u$ each of which includes a cylindrical body $CO_{11}$ and a flange $CO_{12}$ integrally formed at one end of the cylindrical body $CO_{11}$, with the plural unit cores $CO_u$ being connected together. In order to interconnect adjacent unit cores $CO_u$, each unit core may have a suitable connecting segment. For example, a central area of an end wall of the flange CO21 of the unit core $CO_u$ is formed with a threaded bore sb, and a central area of the other end of the unit core $CO_u$ is formed with an interconnecting element composed of an axially extending threaded portion. Screwing the threaded portion of one unit core $CO_u$ to the threaded bore sb of adjacent unit core $CO_u$ allows a desired number of unit cores $CO_u$ to be interconnected to one another. Also, the threaded portion formed at the left side of the unit core COu is screwed into the threaded bore formed at the central area of the flange $CO_3$.

Figure 23:
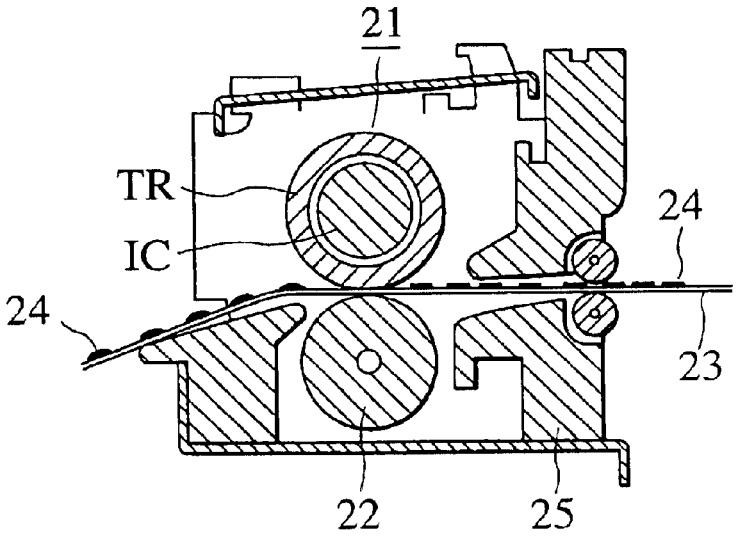
FIG. 23 is a longitudinal cross sectional view illustrating a fixing apparatus of a first preferred embodiment according to the present invention.

FIG. 23 is a longitudinal cross sectional view of a fixing apparatus of a first preferred embodiment according to the present invention.

As shown in FIG. 23, the fixing apparatus of the present invention includes an induction heating roller 21, a pressure roller 22, record medium 23, toner 24 and a frame body 25, with other like parts bearing the same reference numerals as those used in FIG. 9.

Any one of the induction heating rollers 21 shown in FIGS. 8 to 21 may be employed in the structure shown in FIG. 23.

The pressure roller 22 is mounted in a pressured contact relationship with respect to the heating roller TR of the induction heating roller 21, with record medium 23 being transferred between the both rollers in a pressured contact relationship.

Toner 24 is fixed to the surface of record medium 23 for thereby forming a desired image pattern.

The frame body 25 supports the various component parts, discussed above, (except for record medium 23) in a given positional relationship.

As such, the fixing apparatus allows record medium 23, which is adhered with toner 24 to form the desired image pattern, to be interposed between and transferred between the heating roller TR of the induction heating roller 21 and the pressure roller 22, and toner 24 to be applied with heat from the heating roller TR to be melt to carry out thermal fixing of toner 24.

Figure 24:
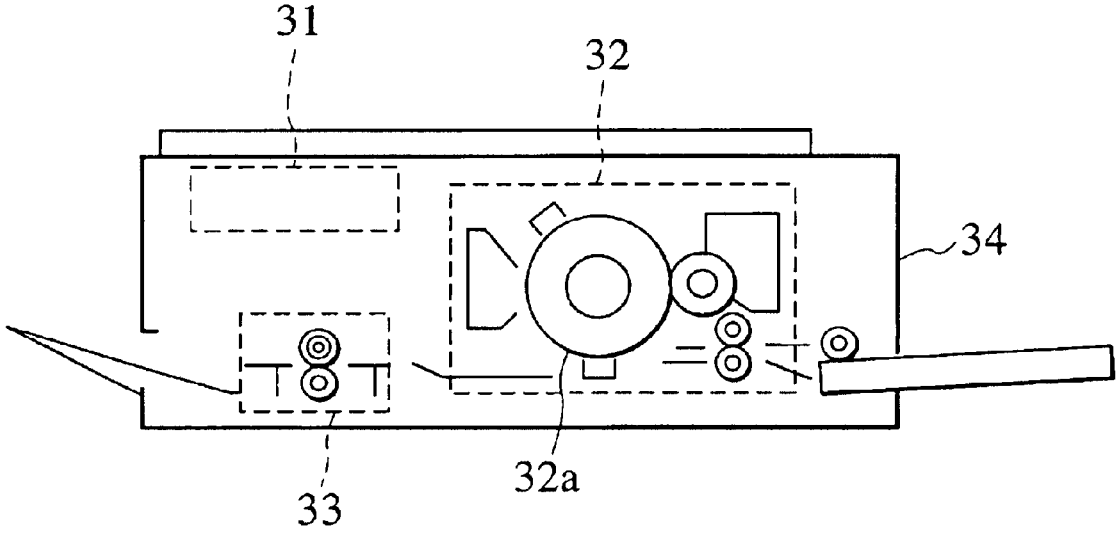
FIG. 24 is a schematic cross sectional view illustrating a copying machine which serves as an image forming apparatus of a first preferred embodiment according to the present invention.

FIG. 24 is a schematic cross sectional view of a copying machine of a preferred embodiment serving as an image forming apparatus.

The image forming apparatus is shown including a reader unit 31, an image forming unit 32, a fixing unit 33 and a case 34.

The reader unit 31 optically reads out image pattern of original sheet to produce an image signal indicative thereof.

The image forming unit 32 responds to the image signal for producing electrostatic charge of a latent image on a photosensitive drum 32*a*, with toner being adhered to the electrostatic charge of the latent image to form reversed image pattern which in turn is transferred onto record medium, such as a paper sheet, to form a desired image pattern.

The fixing unit 33 has a structure shown in FIG. 23 for thermally melting toner, which is transferred to record medium, to cause toner to be thermally fixed thereto.

The case 34 conceals the various component parts discussed above involving the component parts 31 to 33 and includes a transfer unit, electric power supply and a control unit.

The entire content of a Japanese Patent Application No. P2001-016335 with a filing date of Jan. 24, 2001 is herein incorporated by reference.

Although the invention has been described above by reference to the preferred embodiments, the invention is not limited to the embodiment described above and other variations or modifications will occur to those skilled in the art, in light of the teachings. The scope of the invention is defined with reference to the following claims.

What is claimed is:

1. An induction heating roller device comprising:

an induction coil unit having a primary coil;

a hollow heating roller having a secondary coil; and a coreless transformer coupling configured to couple the primary coil to the secondary coil, said secondary coil having a secondary resistance value substantially equal to a secondary reactance, and said hollow heating roller being rotatably supported.

2. The induction heating roller device according to claim 1, wherein:

said secondary coil has a closed circuit.

3. The induction heating roller device according to claim 1, wherein:

said induction coil unit includes a wire pair leading from said primary coil; and a capacitor connected between said wire pair in close proximity to said primary coil.

4. The induction heating roller device according to claim 3, wherein:

said primary coil includes a plurality of primary coil components dispersedly located along an axis of said heating roller and connected between said wire pair; and said capacitor includes a plurality of capacitor components connected between said wire pair in close proximity to said plurality of primary coil components, respectively.

5. The induction heating roller device according to claim 1, wherein:

said heating roller has an outermost circumferential periphery covered with a layer of plastic resin.

6. An induction heating roller device comprising:

an induction coil unit having a primary coil;

a hollow heating roller having a secondary coil coupled to the primary coil of said induction coil unit through a coreless transformer coupling and having a secondary resistance value substantially equal to a secondary reactance, said heating roller being rotatably supported; and a power supply including a high frequency inverter composed of switching elements including uni-pole elements for producing a high frequency output of a frequency more than 1.1 MHz to energize the primary coil of said induction coil unit.

7. An induction heating roller device comprising:

an induction coil unit having a primary coil with a mid point thereof being connected to the ground;

a hollow heating roller having a secondary coil coupled to the primary coil of said induction coil unit through a coreless transformer coupling and composed of a closed circuit, said secondary coil having a secondary resistance value substantially equal to a secondary reactance, said heating roller being rotatably supported;

a power supply for energizing the primary coil of said induction heating coil unit; and a smoothing circuit interposed between said induction coil unit and said power supply unit.

8. The induction heating roller device according to claim 7, wherein:

said induction coil unit includes a heat conducting path located at one end of said heating roller and composed of a ground connection path leading from a mid point of said primary coil.

9. A fixing apparatus comprising:

a fixing frame body including a pressure roller; and an induction heating roller device including a hollow heating roller held in pressured contact with said pressure roller to allow record medium, which is adhered with toner image, to be transferred through said both rollers for thereby causing said toner image to be fixed to said record medium, wherein said induction heating roller device further includes an induction coil unit having a primary coil, the hollow heating roller having a secondary coil, and a coreless transformer coupling configured to couple the primary coil to the secondary coil, said secondary coil having a secondary resistance value substantially equal to a secondary reactance, and said hollow heating roller being rotatably supported.

10. A fixing apparatus comprising:

a fixing frame body including a pressure roller; and an induction heating roller device including an induction coil unit having a primary coil, a hollow heating roller held in pressured contact with said pressure roller to allow record medium, which is adhered with toner image, to be transferred through said both rollers for thereby causing said toner image to be fixed to said record medium;

wherein said hollow heating roller includes a secondary coil coupled to the primary coil of said induction coil unit through a core-less transformer coupling and having a secondary resistance value substantially equal to a secondary reactance, said hollow heating roller being rotatably supported; and wherein said induction heating roller includes a hollow roller base body made of electrically non-conductive material, and a plurality of secondary coil components composed of respective closed circuits circumferentially wound around said roller base body and distributed along an axis of said roller base body.

11. An image forming machine comprising:

an image forming frame body including an image forming unit for forming toner image on record medium; and a fixing unit mounted in said body for causing said toner image to be fixed to said record medium, wherein said fixing unit includes a body having a pressure roller, and an induction heating roller device including a hollow heating roller held in pressured contact with said pressure roller to allow said record medium, which is adhered with said toner image, to be transferred through said both rollers for thereby causing said toner image to be fixed to said record medium, and wherein said induction heating roller device further includes an induction coil unit having a primary coil, the hollow heating roller having a secondary coil, and a coreless transformer coupling configured to couple the primary coil to the secondary coil, said secondary coil having a secondary resistance value substantially equal to a secondary reactance, and said hollow heating roller being rotatably supported.

12. An induction heating roller device comprising:

an induction coil unit having a primary coil;

a hollow heating roller having a secondary coil and a layer of plastic resin; and a coreless transformer coupling configured to couple the primary coil to the secondary coil, said secondary coil having a secondary resistance value substantially equal to a secondary reactance, and said hollow heating roller being rotatably supported.

13. The device of claim 12, further comprising:

a glass sealing layer provided between the secondary coil and the layer of plastic resin.

14. The device of claim 12, further comprising:

an electrically non-conductive base body provided on an innermost circumferential surface of the hollow heating roller.

* * * * *